US010709952B2

(12) United States Patent
Shwartzman

(10) Patent No.: US 10,709,952 B2
(45) Date of Patent: Jul. 14, 2020

(54) TENNIS STROKE PRACTICE DEVICE

(76) Inventor: Ian Shwartzman, San Bernardino, CA (US)

( * ) Notice: Subject to any disclaimer, the term of this patent is extended or adjusted under 35 U.S.C. 154(b) by 1754 days.

(21) Appl. No.: 13/313,376

(22) Filed: Dec. 7, 2011

(65) Prior Publication Data

US 2012/0264550 A1 Oct. 18, 2012

Related U.S. Application Data

(60) Provisional application No. 61/517,151, filed on Apr. 15, 2011.

(51) Int. Cl.

| | |
|---|---|
| ***A63B 69/38*** | (2006.01) |
| ***A63B 60/04*** | (2015.01) |
| ***A63B 65/12*** | (2006.01) |
| ***A63B 21/00*** | (2006.01) |
| *F41B 3/04* | (2006.01) |
| *A63B 71/06* | (2006.01) |
| *A63B 60/34* | (2015.01) |
| *A63B 60/16* | (2015.01) |
| *A63B 59/20* | (2015.01) |

(52) U.S. Cl.

CPC ..... *A63B 69/38* (2013.01); *A63B 21/0004* (2013.01); *A63B 21/4021* (2015.10); *A63B 21/4035* (2015.10); *A63B 60/04* (2015.10); *A63B 65/122* (2013.01); *A63B 59/20* (2015.10); *A63B 60/16* (2015.10); *A63B 60/34* (2015.10); *A63B 2071/0625* (2013.01); *A63B 2209/08* (2013.01); *A63B 2210/50* (2013.01); *F41B 3/04* (2013.01)

(58) Field of Classification Search

CPC ..... A63B 49/08; A63B 60/06; A63B 60/08; A63B 69/38; A63B 65/00; A63B 65/12; A63B 65/122; A63B 59/20; A63B 60/04; A63B 60/34; A63B 60/16; A63B 21/0004; A63B 21/4021; A63B 21/4035; A63B 2071/0625; A63B 2209/08; A63B 2210/50; A63H 33/18; F41B 3/04

USPC ..... 473/459, 461, 463, 464, 519, 549

See application file for complete search history.

(56) References Cited

U.S. PATENT DOCUMENTS

| | | | | |
|---|---|---|---|---|
| 514,420 A * | 2/1894 | Jacobus | ..... | A63B 59/50 473/519 |
| 1,374,420 A * | 4/1921 | Berggreen | ..... | A63B 65/02 124/5 |
| 1,919,706 A * | 7/1933 | Winzer | ..... | A63B 59/20 473/505 |

(Continued)

*Primary Examiner* — Raleigh W Chiu

(74) *Attorney, Agent, or Firm* — Ariel S. Bentolila; Bay Area IP Group, LLC

(57) ABSTRACT

A tennis stoke practice device comprises a tube comprising a first end, a second end and a hollow interior. The first end and the second end are operable for joining of accessories. A grip-bud is removably joinable to the first end. The grip-bud is configured to close the hollow interior at the first end. A grip is joined to the tube to abut the grip-bud. The grip-bud and grip comprise an octagonal shape. A movable insert is configured for projectile movement through the hollow interior in which, during a desired swing of the device, a longitudinal axis of the movable insert is substantially aligned with a longitudinal axis of the hollow interior. During an undesired swing of the device, the longitudinal axis of the movable insert rotates out of alignment with the longitudinal axis of the hollow interior.

2 Claims, 20 Drawing Sheets

(56) References Cited

U.S. PATENT DOCUMENTS 2,379,006 A * 6/1945 Johnson ..... A63B 53/08 138/144
3,031,191 A * 4/1962 Bonang ..... A63B 67/10 473/576
3,115,129 A * 12/1963 Merriman ..... A63B 59/20 124/41.1
3,137,504 A * 6/1964 Zordan ..... A63B 24/0062 446/137
3,498,616 A * 3/1970 Hurst ..... A63B 69/3635 473/234
3,578,801 A * 5/1971 Piazza ..... A63B 59/50 473/457
4,325,549 A * 4/1982 Vasselli ..... A63B 60/04 473/519
4,671,508 A 6/1987 Tetreault
4,898,386 A * 2/1990 Anderson ..... A63B 49/00 473/457
4,967,596 A 11/1990 Rilling
5,133,551 A * 7/1992 Handy ..... A63B 59/50 473/567
RE34,032 E * 8/1992 Callaghan ..... A63H 33/18 473/575
5,451,047 A * 9/1995 Liu ..... A63B 59/50 473/457
5,522,372 A * 6/1996 Gerstikov ..... A63B 59/20 124/5
5,556,319 A * 9/1996 Watkins ..... A63H 37/00 124/5
5,590,875 A * 1/1997 Young ..... A63B 43/00 473/451
5,653,664 A 8/1997 Jennings
5,813,931 A * 9/1998 Gormley ..... A63B 43/00 473/575
6,083,128 A * 7/2000 Young ..... A63B 43/02 124/5
6,241,629 B1 * 6/2001 Otto ..... A63B 69/0002 124/5
6,302,813 B1 * 10/2001 Sturgeon ..... A63B 59/50 446/419
6,733,405 B2 * 5/2004 Gormley ..... A63B 43/007 473/575
6,805,005 B1 10/2004 Elizondo
7,147,580 B2 * 12/2006 Nutter ..... A63B 15/005 473/457
8,137,219 B2 * 3/2012 Gant ..... A63B 15/02 473/233
8,888,614 B2 * 11/2014 Nutter ..... A63B 69/0002 473/422
9,144,726 B2 * 9/2015 Whitney ..... A63B 69/0002
2002/0187847 A1 12/2002 Jelinek
2003/0022739 A1 * 1/2003 Vannoy ..... A63B 47/02 473/505
2004/0029656 A1 * 2/2004 Vannoy ..... A63B 65/122 473/505
2007/0105663 A1 * 5/2007 Farnsworth ..... A63B 15/00 473/422
2012/0264550 A1 * 10/2012 Shwartzman ..... A63B 69/38 473/463
2015/0045155 A1 * 2/2015 Chen ..... A63B 60/38 473/564
2015/0137454 A1 * 5/2015 Burks ..... A63F 7/2436 273/405

* cited by examiner 6
5
45
10
4
7
3
1

44

5
11
13
6
16
15
12
39
7
9
14
8

2
1
42
18
17
8
4
7
41
1
42
1

22
23

23
24

23

23

22
22
25

TENNIS STROKE PRACTICE DEVICE

CROSS-REFERENCE TO RELATED APPLICATIONS

The present Utility patent application claims priority benefit of the U.S. provisional application for patent Ser. No. 61/517,151 entitled "Bullet", filed on Apr. 15, 2011, under 35 U.S.C. 119(e). The contents of this related provisional application are incorporated herein by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to sporting equipment. More particularly, the invention relates to a device to aid in practicing a tennis stroke.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. In a game of tennis the ball typically travels very fast (i.e., one or two seconds to travel from one side of the court to the other side), and in many situations a player has no time to take a big swing or step. Taking a short and powered stroke and step while keeping the hands in front of the body is often an effective technique, which is contemplated to become a prominent feature in future games of tennis. It is believed that correct racquet and body position during a swing is best practiced without a ball and with some distinctive point of attention to give the player opportunity to learn, practice, remember and use the practiced techniques in an actual game. By way of educational background, an aspect of the prior art generally useful to be aware of is that some currently existing devices for practicing a tennis swing comprise a movable object within a closed housing that creates a sound, for example, without limitation, by striking the interior of the housing or by pushing air through openings in the housing to create a whistling sound. Other current devices do not include a movable object and instead create a sound when a portion of the device vibrates or when air moves across particular areas of the device such as, but not limited to, holes or corrugated tubes.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 is a diagrammatic side view of the device. FIG. 2 is a diagrammatic side view of an exemplary straight central tube. FIG. 3 is a perspective end view of a grip side of the device. FIG. 4 is an exploded side view of the device, and FIG. 5 is an exploded side view of the device with two impact caps;

FIG. 6 is a diagrammatic side view. FIG. 7 is an exploded perspective view. FIG. 8 and FIG. 9 show the device in use;

FIGS. 10 through 13 illustrate an exemplary movable insert and an exemplary impact transmitter in a stroke practice device, in accordance with an embodiment of the present invention. FIG. 10 is a side perspective view. FIGS. 11 and 12 are side perspective views of the movable insert and the impact transmitter within a partially cutaway view of the device. FIG. 13A shows the impact transmitter after a correct impact from the movable insert, and FIG. 13B shows the impact transmitter after an incorrect impact from the movable insert;

FIG. 14 is a cross sectional view. FIG. 15 is a side perspective view. FIG. 16 is a side perspective view, and FIG. 17 is a bottom perspective view;

FIG. 18 is a diagrammatic side view. FIG. 19 is a cross sectional view. FIGS. 20 and 21 are side perspective views;

FIG. 22 is a diagrammatic side view. FIG. 23 is a side perspective view. FIG. 24 is an end view of the movable insert in a tube. FIG. 25 is a side view of the movable insert in line with an impact transmitter, and FIG. 26 is a side view of the movable insert out of alignment with the impact transmitter;

FIG. 27 is a side perspective view. FIG. 28 is a diagrammatic end view. FIG. 29 is a cross sectional view. FIG. 30 is a side view with a tail extended. FIG. 31 shows the air movement around the movable insert. FIG. 32 shows the pressure within the movable insert. FIG. 33 and FIG. 34 illustrate the movable insert in use;

FIG. 35 is a diagrammatic side view of the balance adjuster on a device. FIG. 36 is a cross sectional view of the balance adjuster on a tube, and FIG. 37 is a side perspective view of the balance adjuster on the tube;

FIG. 42A is a diagrammatic front view, FIG. 42B is a side perspective view, and FIG. 42C is a side perspective view of a soft impact screen;

FIG. 43A is a diagrammatic front view. FIG. 43B is a side perspective view, and FIG. 44 shows the weight attachment being attached to a stroke practice device;

FIG. 45 is a partially exploded view, and FIG. 46 shows the device in use hitting a ball;

FIG. 47 is a partially exploded view, and FIG. 48 shows swing net 30 in use with a ball FIG. 49 shows a user before taking a swing, and FIG. 50 shows the user during a swing;

FIG. 54 is a diagrammatic side view, and FIG. 55 is a partially cut away view.

Figure 1:
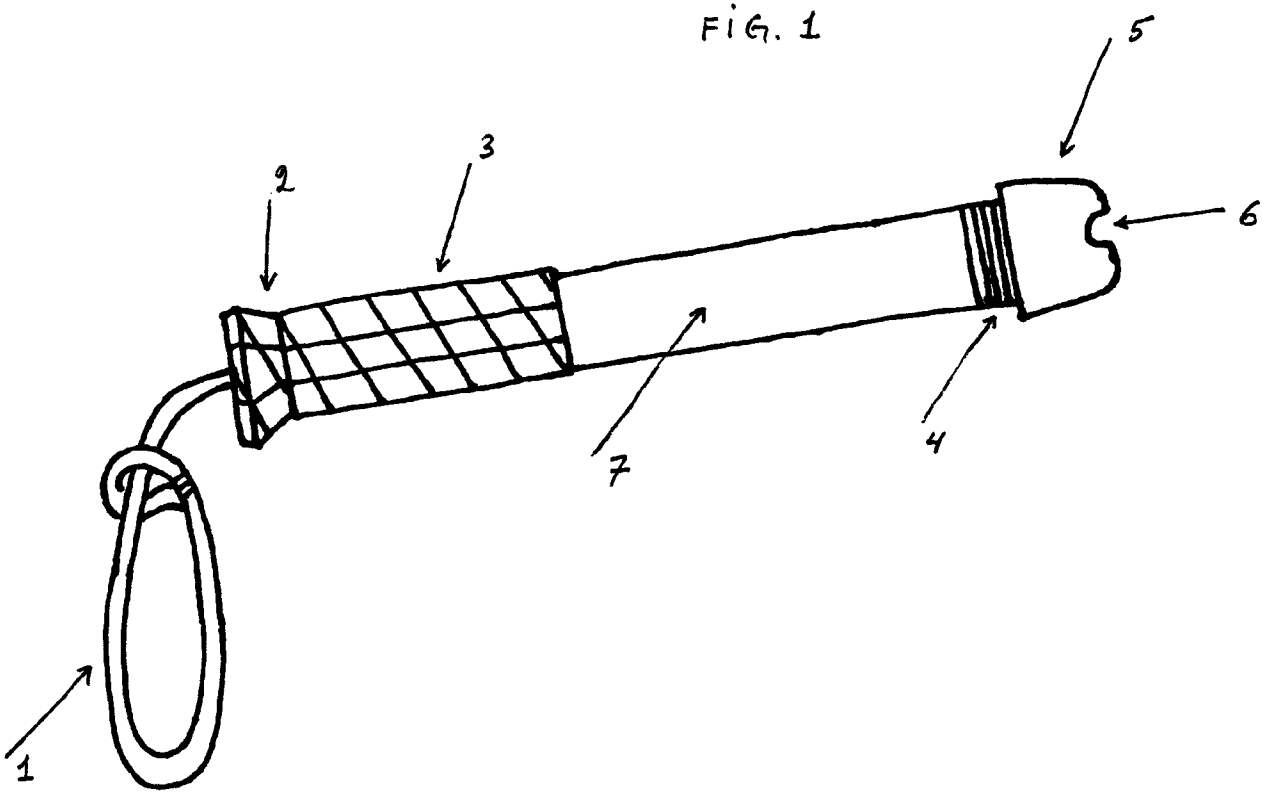
FIGS. 1 through 5 illustrate an exemplary tennis stroke practice device, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present application or of any further application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

A practical embodiment of the present invention provides a device to aid in practicing tennis strokes. In contemporary fast moving tennis, players often stay close to the baseline for an early return and have limited time and distance in which to make a stroke. It is believed that athletic skills and correct tennis racquet position are important to produce these kinds of strokes. Many practical embodiments enable a user to practice racquet position and fast initiation of a stroke effectively. Extension is important for power and to control the direction of a stroke, and the fast play of contemporary tennis also means that a player typically has a short period of time to bring the racquet back to a starting position for a new stroke. Many practical embodiments enable a user to practice a controlled extension and return by providing an impact sound, weight and a visual focal point. Moving the body forward during the stroke helps to produce a powerful stroke with a shorter hand movement. Many practical embodiments have a relatively heavy weight and may also comprise various different attachments to help practice this forward movement. After the initiation of the stroke a hand relaxation period enables the player to keep the initial, active speed of the racquet and provide time to enable the racquet strings to flex when striking the tennis ball. To produce a stroke using many practical embodiments, only a fast and powerful initial move is required and there is typically no extinguish influence. This provides a good feel and better understanding of a stroke relaxation period. To maintain the correct direction, speed and trajectory of the ball after the stroke, a player generally should follow through in the path of the ball. Many practical embodiments comprise a colored focal point to provide visual understanding of the racquet position and the direction of the stroke.

Many practical embodiments comprise a movable insert within a closed housing with an impact cap. The striking of the movable insert against the impact cap creates different sounds depending on the way in which the insert strikes the impact cap as dictated by the swing of a user. This difference in sound enables the user to hear when a correct swing has been made. Furthermore, many practical embodiments comprise removable ends that enable various different objects to be attached to the device such as, but not limited to, straps, different types of grips, various accessories, etc.

Some current devices for practicing a tennis swing comprise a movable insert that impacts a blunt, flat, stationary surface and have permanently closed housings. An impact on a blunt, flat, stationary surface cannot produce sounds of different quality. Other current devices create sounds using different means such as, but not limited to a vibrating horn with one side permanently fixed to the device or a corrugated, hollow tube. Any motion in air produces a sound in these devices and this sound is typically dependent on the speed of the action and the size of surface affected by this motion. Using a corrugated form provides more surface area to be contacted by the airflow, which increases the volume of the sound produced. In one current device the main sound is a whistle produced by a movable weight pushing air inside the device through openings. In many current devices with a movable insert, this insert has no specific form, weight or impact surface. Instead, the insert generally corresponds to the shape of the device with a smaller diameter and typically strikes a flat impact surface. This means that the impact sound differs only by volume and does not change with the applied technique of a swing. In many practical embodiments of the present invention the quality of the sound produced helps a user bring correct technique and self-control to the practice of their swing. In an actual game of tennis the sound of strokes can be very distinctive with a stroke at the sweet spot with high speed and extension typically producing an explosive, loud and clear sound and a stroke away from the sweet spot with poor technique and extension typically producing a quieter, dull and vague sound even if the same force is applied. Many current devices comprise permanently closed ends and slightly convex grip ends similar to the grip of a baseball bat. Many practical embodiments comprise removable ends and octagonal grip ends similar to tennis racquets. Other practical embodiments may comprise grip ends of various different shapes or exchangeable grip ends. Furthermore, current devices are generally designed for stroke exercises (i.e., forehand, backhand and serve) and may not be applied to volley exercises. Some practical embodiments may be implemented for use in volley exercises.

Figure 2:
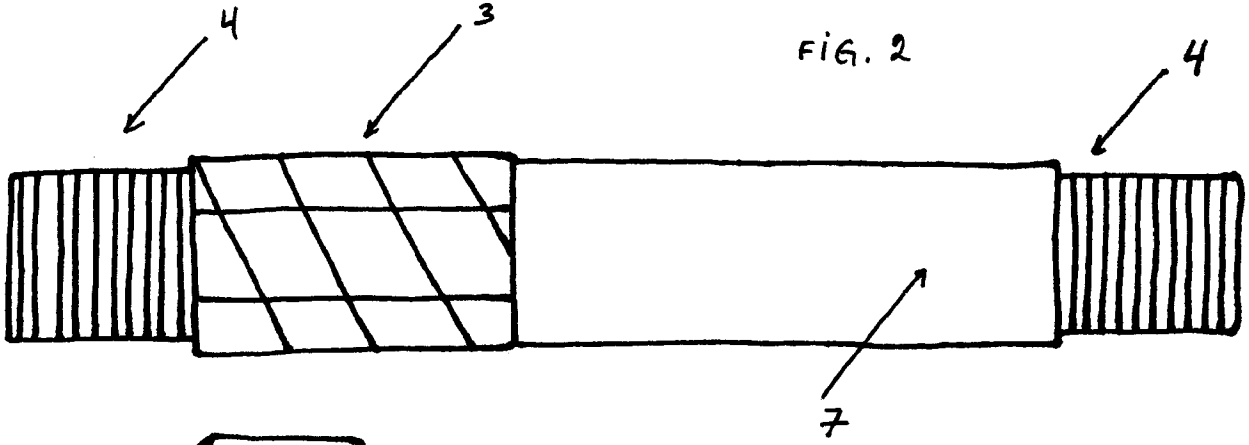
Figure 3:
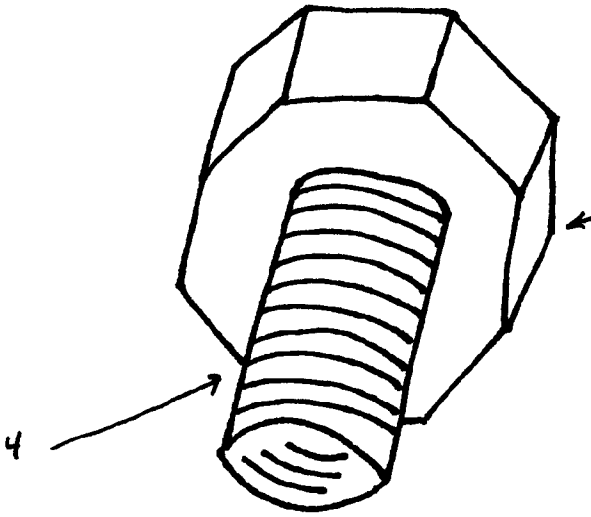
Figure 4:
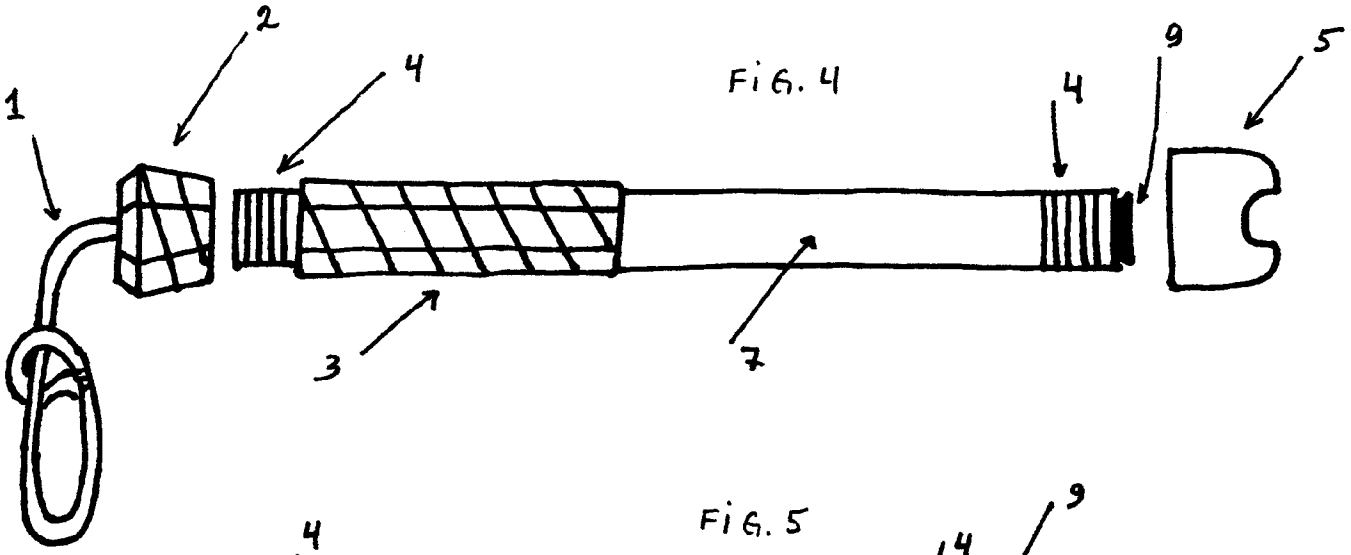
Figure 5:
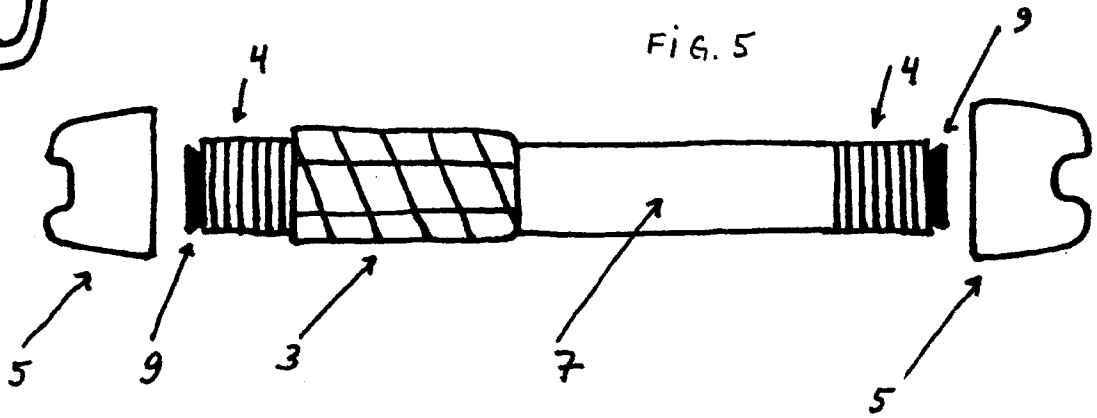

FIGS. 1 through 5 illustrate an exemplary stroke practice device, in accordance with an embodiment of the present invention. FIG. 1 is a diagrammatic side view of the device. FIG. 2 is a diagrammatic side view of an exemplary straight central tube 7. FIG. 3 is a perspective end view of a grip side of the device. FIG. 4 is an exploded side view of the device, and FIG. 5 is an exploded side view of the device with two impact caps 5. In the present embodiment, the device comprises a securing strap 1, a grip-bud 2, a grip 3, tube threads 4 on straight central tube 7, and impact cap 5 comprising an attachment hole 6. Straight central tube 7 is made from a plastic or metal material and designed to accept attachments from the grip side and a free side on threads 4 located on both sides of straight central tube 7, as shown by way of example in FIGS. 2, 4 and 5. For example, without limitation, a weight may be attached to the free side and a resistance attachment may be attached to the grip side, or weights may be attached to both sides, etc. Providing threads 4 on both sides of straight central tube 7 also allows for the accommodation of different attachments for practicing forward and backward moving exercises at the same level of force. Many currently available devices comprise only one active side and are not designed for attaching accessories to both sides. In some alternate embodiments, tubes of various different sizes and lengths may be provided.

Referring to FIGS. 1 and 4, in the present embodiment, detachable grip-bud 2 is shown attached to grip 3 on the grip side of straight central tube 7. Secure strap 1 is attached to grip-bud 2 to secure the device to the wrist of a user during use. Referring to FIGS. 1, 3 and 4, grip-bud 2 and grip 3 are lightweight to preserve the front balance of the device and are octagonal in shape similar to an actual tennis racquet. Grip-bud 2 is also able to produce an impact sound and comprises space inside to house an impact transmitter and allow for the movements of this impact transmitter, as shown by way of example in FIG. 19. Referring to FIGS. 1, 4 and 5, impact cap 5 is a removable element made from a plastic or metal material and designed to be connected by a threaded portion to threads 4 on the grip side and the free side of straight central tube 7. During use, impact cap 5 receives an impact from an impact transmitter, shown by way of example in FIGS. 10 through 13, at the time of a stroke. Referring to FIG. 1, attachment hole 6 is located in the middle of impact cap 5 for receiving a connecting bolt. In the present embodiment, impact cap 5 has a yellow color, which is distinctive from the rest of the device. This differentiation in color provides a focal point for a user to look at during preparation for a stroke. There are many reasons for this including, without limitation, focusing on this point can help the user control the tennis racquet position for better stroke technique and power, can help the user practice a short, fast swing and can help the user practice the correct racquet position to activate torso muscles, which can provide more power and lower the risk of injury in comparison to swings that mostly activate the smaller shoulder muscles. Tennis professionals typically instruct students to keep the tennis racquet in a view when preparing for a stroke. However, this is difficult during play as the eyes of a tennis player are usually focused on the ball. Therefore, it is believed that the correct racquet position is best practiced without a ball and with some distinctive point of attention to give the body opportunity to learn, practice, remember the correct technique and to use it in an actual game. In the present embodiment, the distinctive color of impact cap 5, which is about the same size as a typical tennis ball, enables a user to keep the device at the correct position during stroke preparation and control the stroke while swinging, as impact cap 5 is clearly visible.

Figures 6, 7:
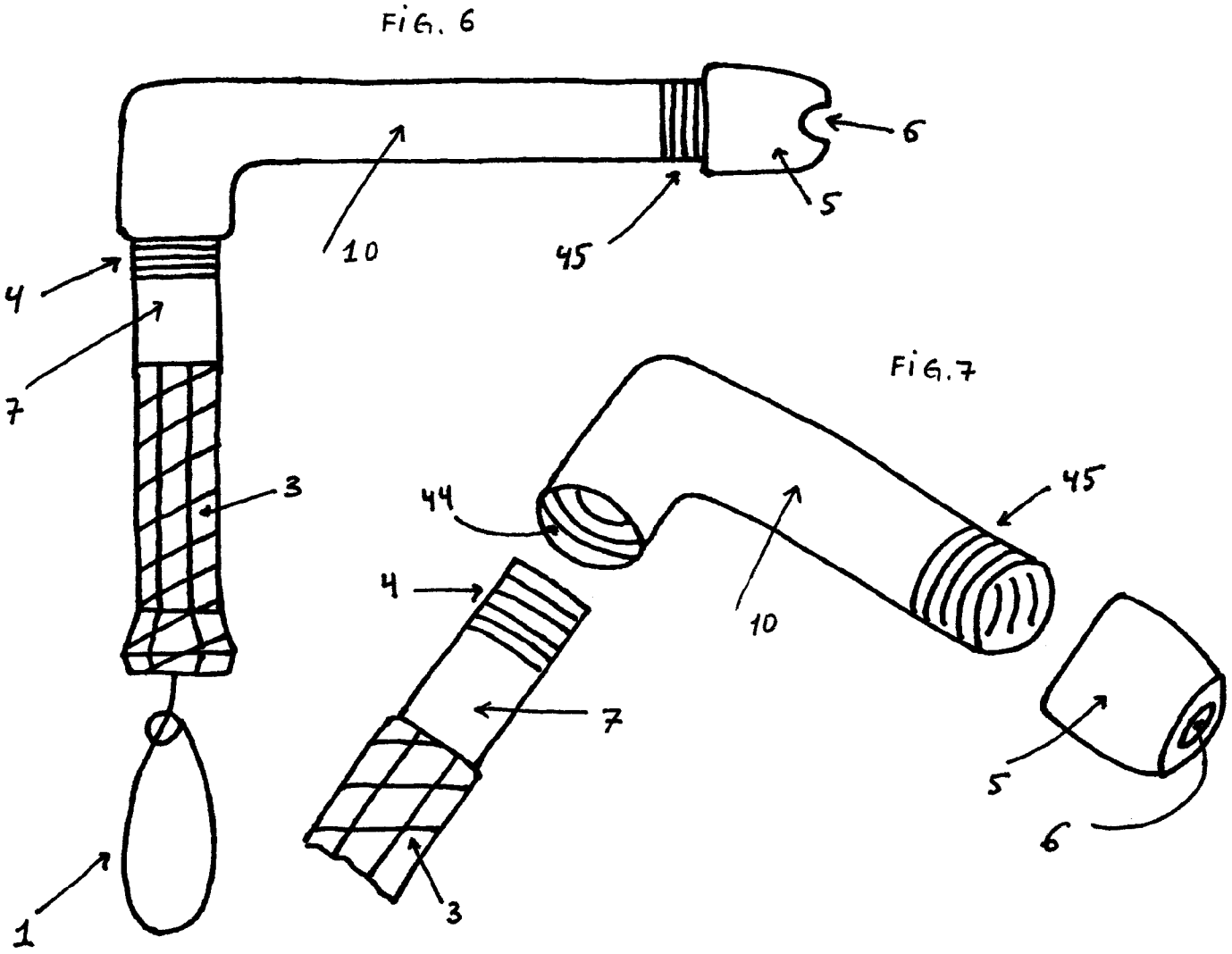
FIGS. 6 through 9 illustrate an exemplary stroke practice device with a curved tube, in accordance with an embodiment of the present invention.
Figure 9:
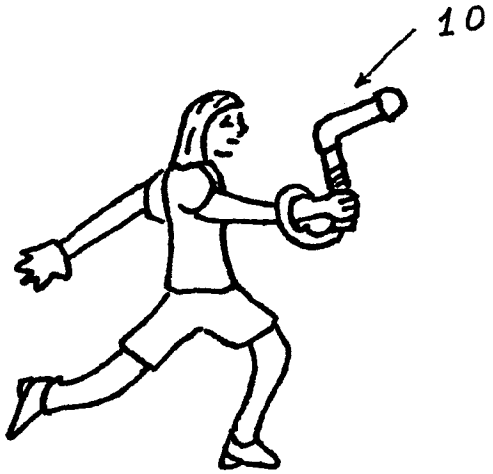
Figure 8:
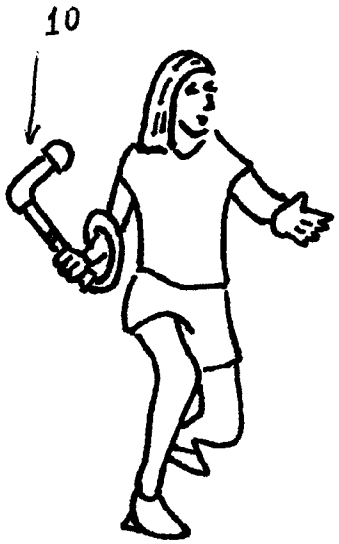

FIGS. 6 through 9 illustrate an exemplary stroke practice device with a curved tube 10, in accordance with an embodiment of the present invention. FIG. 6 is a diagrammatic side view. FIG. 7 is an exploded perspective view. FIG. 8 and FIG. 9 show the device in use. In the present embodiment, curved tube 10 enables the device to be used for volley exercises. Many current devices are designed only for stroke exercises (i.e., forehand, backhand and serve) and do not enable a user to practice volley exercises. A good volley technique is a very important part of a game of tennis. In volley exercises, the position of an active part of the device must be at a 90-degree angle to a grip 3. Curved tube 10 is bent at approximately a 90-degree angle. A straight tube 7 connected to grip 3 acts as a passive grip and curved tube 10 comprises a movable insert inside to make curved tube 10 the active part. Curved tube 10 is made from plastic or metal material and has female and male connectors. Referring to FIG. 7, curved tube 10 connects to threads on a free side of straight central tube 7 by a female connector 44, and comprises a male connector 45 for connecting attachments such as, but not limited to, an impact cap 5, weight and resistance attachments, etc.

Referring to FIGS. 8 and 9, in typical use of the present embodiment, a user volley exercises as shown. A ready position of volley is with a racquet in front of middle and upper part of a body. Hands and racquet relation are about 90 degrees. Knees are banded with legs open in size of shoulders. Only punching movements with step forward are used with no follow through or torso rotation. A very fast motion returns the racquet back to a ready position. FIG. 8 shows a ready position and relative position of curved tube 10 in front of an upper part of a body with impact cap 5 pointed forward. FIG. 9 shows a relative position of curved tube 10 with a forward movement (step forward). Curved tube 10 is in front of the upper part of the body with an impact cap 5 pointed forward. With the movable insert and an impact transmitter placed in the curved tube 10 it is the active part of a device with all impact sounds characteristic of the motion. Volley exercised are possible from backhand and forehand side, low and high—like in actual practice with a tennis racquet.

Figures 10, 11, 12, 13A, 13B:
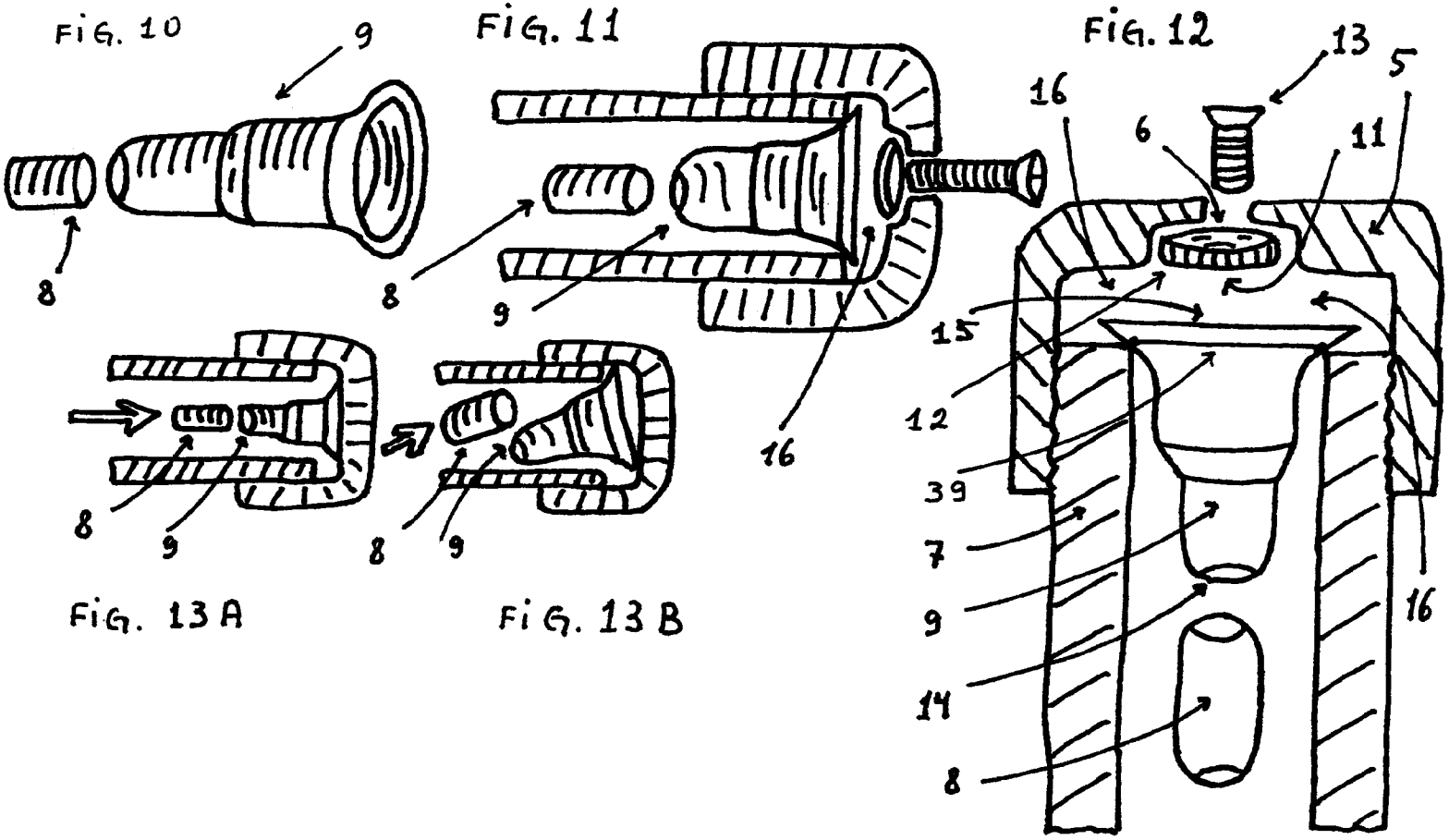

FIGS. 10 through 13 illustrate an exemplary movable insert 8 and an exemplary impact transmitter 9 in a stroke practice device, in accordance with an embodiment of the present invention. FIG. 10 is a side perspective view. FIGS. 11 and 12 are side perspective views of movable insert 8 and impact transmitter 9 within a partially cutaway view of the device. FIG. 13A shows impact transmitter 9 after a correct impact from movable insert 8, and FIG. 13B shows impact transmitter 9 after an incorrect impact from movable insert 8. In the present embodiment, the active part of the device comprises free moving impact transmitter 9 which is positioned between the inner side of an impact cap 5 and the free end of a tube 7 and movable insert 8 that can freely move within tube 7. Tube 7 may be a straight or curved tube. Between the free end of tube 7 and the inner bottom side of impact cap 5 is a 5 to 7 mm gap 16 into which impact transmitter 9 may move during impact to allow full contact between impact cap 5 and impact transmitter 9 during a stroke. Referring to FIG. 12, impact transmitter 9 rests on tube 7 at a flange 39 when the device is at rest. In the middle of the inner bottom side of impact cap 5 is a notch 11 into which a nut 12 may be placed and an attachment hole 6 that is the appropriate size for a connecting bolt 13.

In the present embodiment, at least impact transmitter 9, impact cap 5 and movable insert 8 are constructed from a metal material. In other embodiments, these elements may be constructed from other solid materials that produce the desired effects according to teachings herein. Impact transmitter 9 comprises an impact acceptor point 14 approximately the same size as movable insert 8 and an impact surface 15 to impact impact cap 5. Impact transmitter 9 produces sounds different in quality and volume depending on how movable insert 8 impacts it, which is dictated by the stroke of a user. The impact of movable insert 8 and impact transmitter 9 produces a first and second impact sound. The first impact sound is the impact of movable insert 8 and impact transmitter 9. The quality of this sound depends on the angle of movable insert 8 in relation to impact transmitter 9. The second impact sound is the impact of impact transmitter 9 and impact cap 5. The quality of this sound depends on how squarely impact transmitter 9 contacts impact cap 5. Referring to FIG. 13A, a perfect stroke with deep extension forward, a straight motion and high initial speed produces a correct impact where the center lines of movable insert 8 and impact transmitter 9 are on the same course with an impact force. A correct stroke impact enables impact surface 15 of impact transmitter 9 to forcefully and squarely hit the inner side of impact cap 5 and produce a high quality, clear and explosive sound. Referring to FIG. 13B, deviation of the courses of movable insert 8 and impact transmitter 9 caused by incorrect stroke technique makes the impact zone smaller and the impact force weaker, which typically causes impact transmitter 9 to vibrate and produce an unclear, blunt, and relatively quiet sound. The volume of an impact sound typically depends on applied force. The movable impact transmitter 9 enables the quality of the sound to vary depending on stroke technique and force.

Figure 14:
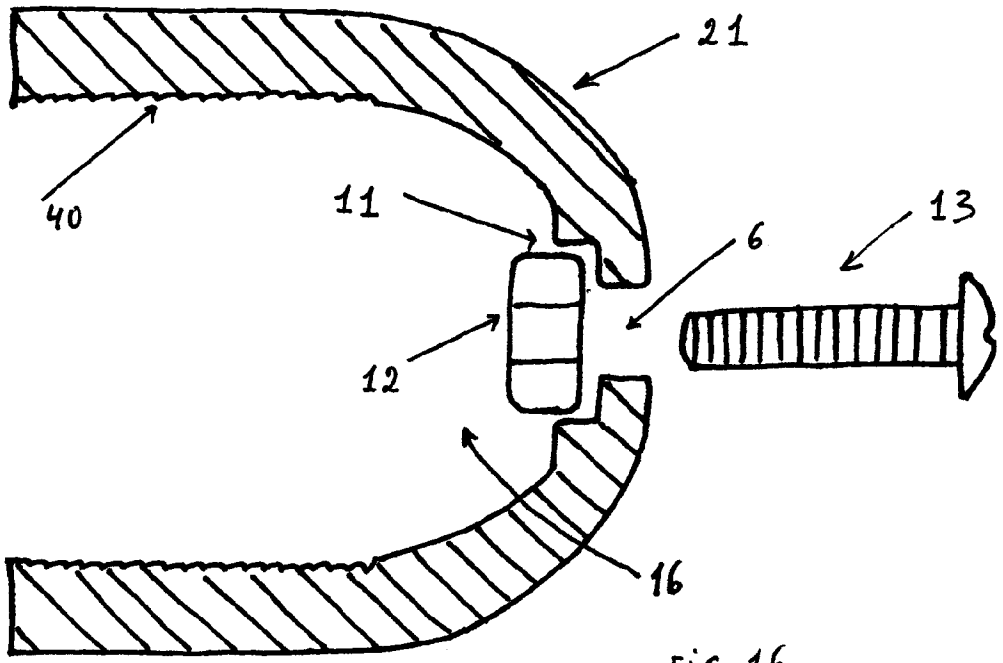
FIGS. 14 through 17 illustrate an exemplary impact cap for a stroke practice device, in accordance with an embodiment of the present invention.
Figure 15:
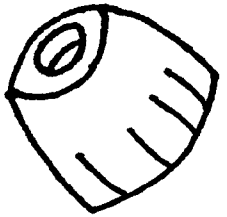
Figure 16:
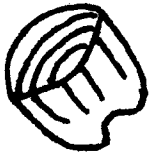
Figure 17:
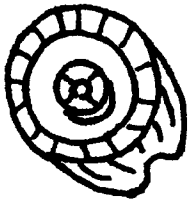

FIGS. 14 through 17 illustrate an exemplary impact cap for a stroke practice device, in accordance with an embodiment of the present invention. FIG. 14 is a cross sectional view. FIG. 15 is a side perspective view. FIG. 16 is a side perspective view, and FIG. 17 is a bottom perspective view. Referring to FIG. 14, in the present embodiment, the impact cap is approximately 2 inches long and comprises threads 40 on an inner side for connection to a straight central or curved tube. A nut 12 can be inserted into a notch 11 in alignment with attachment hole 6 for a connecting bolt 13. Many different attachments can be connected to impact cap including, without limitation, weights, resistance attachments, sweet spot racquets, swing nets, hooks, etc.

Figures 18, 19, 20, 21:
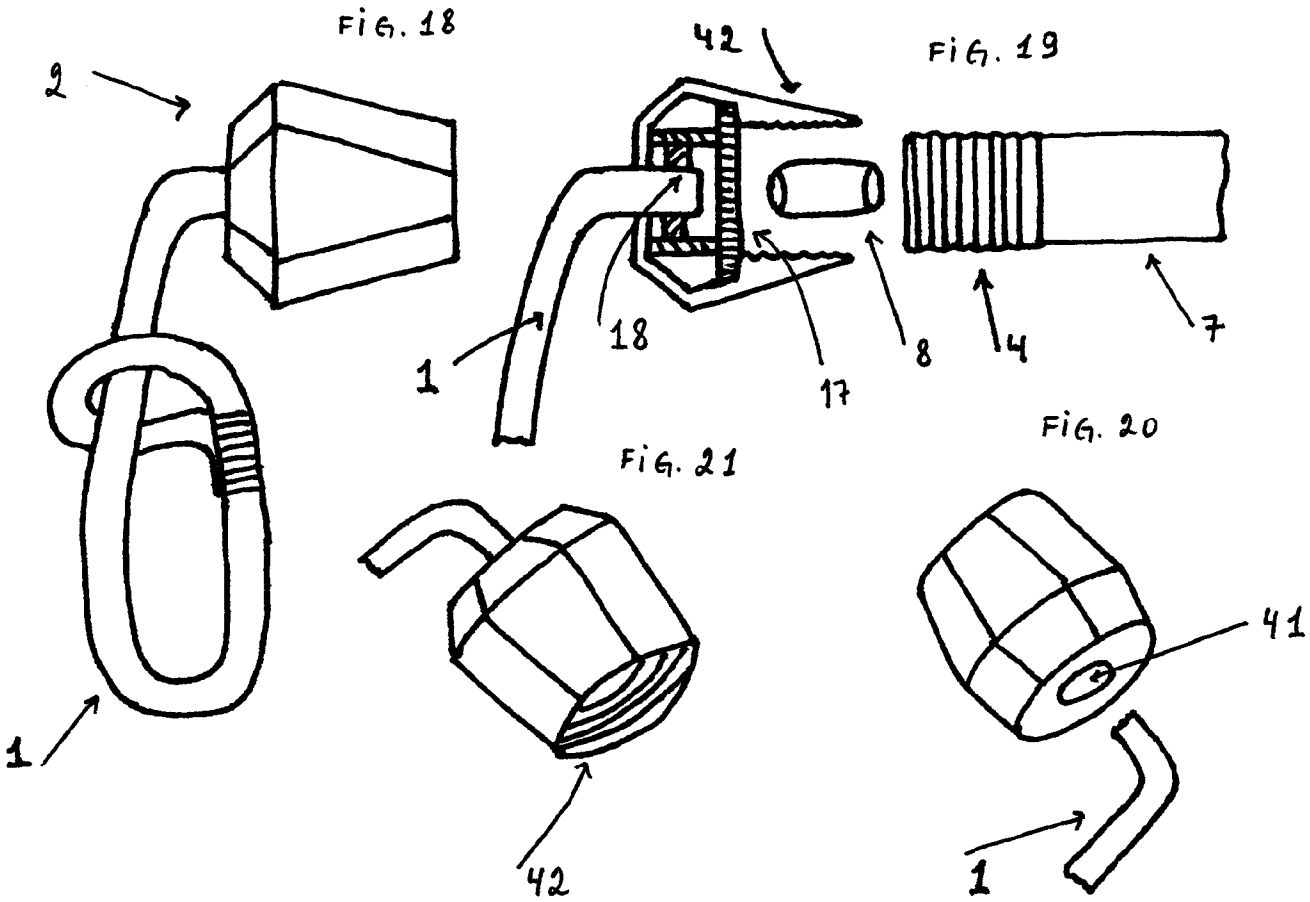
FIGS. 18 through 21 illustrate an exemplary grip-bud for a stroke practice device, in accordance with an embodiment of the present invention.

FIGS. 18 through 21 illustrate an exemplary grip-bud 2 for a stroke practice device, in accordance with an embodiment of the present invention. FIG. 18 is a diagrammatic side view. FIG. 19 is a cross sectional view. FIGS. 20 and 21 are side perspective views. In the present embodiment, grip-bud 2 has an octagon shape similar to a tennis racquet grip and a length of approximately 1½ inches to 2 inches. Referring to FIGS. 19 and 21, on an inner side are threads 42 for connection to a straight central tube 7. A thread connection allows grip-bud 2 to be easily detached from tube 7 to be replaced by accessory parts such as, but not limited to, racquets, tubes, nets, magnets, weights, etc. Referring to FIG. 19, at the end of threads 42 and bonded to the walls is a 3-4 mm thick metal disc 17. Metal disc 17 receives an impact from a movable insert 8 and produces a sound dependant on the force of the impact, which is driven by gravity or a moving back force to generally alert a user when the device has returned to a starting position. There is a gap 18 between metal disc 17 and an inner bottom side of grip-bud 2 into which a secure strap 1 placed through a hole 41 in the free end of grip-bud 2 may be permanently attached. A free side secure strap 1 is generally placed on the wrist or hand of a user to secure the device. Since stoke practice devices may be relatively heavy, secure strap 1 should be used at all times and be intact outside and inside. The detachability of grip-bud 2 enables secure strap to be checked regularly before exercises to generally prevent injury or damage. Currently available devices do not include a detachable grip-bud; instead, they typically have blunt, permanently closed grip ends that are not designed to be changed out for accessory attachments.

Figure 24:
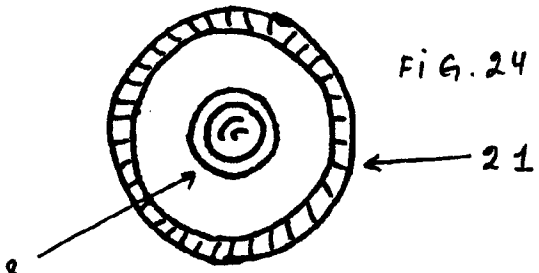
FIGS. 22 through 26 illustrate an exemplary movable insert for a stroke practice device, in accordance with an embodiment of the present invention.
Figure 25:
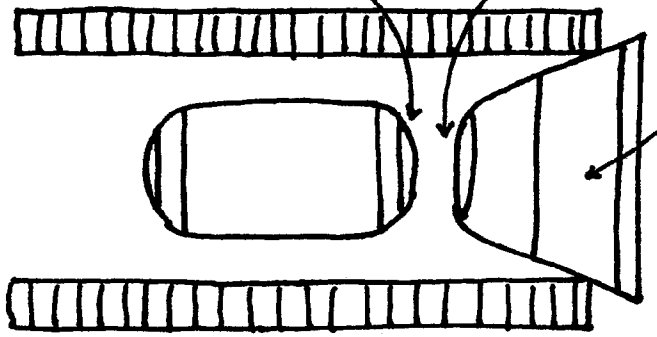
Figure 26:
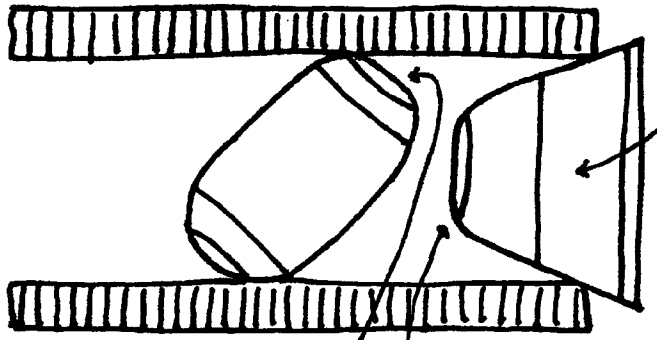
Figure 22:
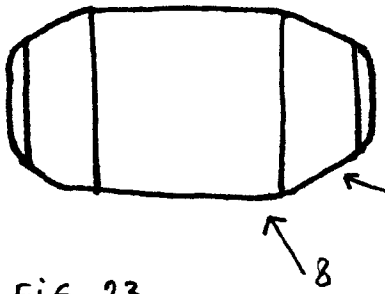
Figure 23:
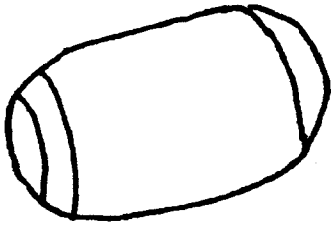

FIGS. 22 through 26 illustrate an exemplary movable insert 8 for a stroke practice device, in accordance with an embodiment of the present invention. FIG. 22 is a diagrammatic side view. FIG. 23 is a side perspective view. FIG. 24 is an end view of movable insert 8 in a tube 21. FIG. 25 is a side view of movable insert 8 in line with an impact transmitter 9, and FIG. 26 is a side view of movable insert 8 out of alignment with impact transmitter 9. In the present embodiment, movable insert 8 is approximately 1 to 1½ inches long, ½ to ⅝ inches in diameter and made from a plastic or metal material. Movable insert 8 may be used in a device for all types of swinging exercises including, without limitation, forehand, backhand and serving. Movable insert 8 has a form and size specially related to the form and size of tube 21 to enable an impact sound to change in quality and to affect the level of force pushing the device forward depending on applied technique. After a user makes a stroke movement using the device, movable insert 8 moves with a high speed to an impact zone of the device, side opposite to the grip, where impact transmitter 9 and impact cap are placed, and produce a high forced impact, transmitted to the device, and moves the device forward (like a soccer player hits a ball, but in this case a leg is a movable insert and a ball is a device). An extension (very important part of a stroke) means to keep the device, by a hand of the user, in the same line and direction with the movable insert force line until all transmitting force is exhausted. This is most efficient way to keep a power and direction of a tennis stroke. If the device is moved by the user from a collision course with the movable insert force line, an effective transmitted energy will be less and a planned stroke direction will be lost. Movable insert 8 has a cylindrical form and two similar ends. These similar ends enable a user to practice backward and forward movement at the same time. Each end comprises a hitting surface 19, which is similar in size to an impact acceptor point 14 of impact transmitter 9. Between hitting surfaces 19 and the body of movable insert 8 is a slope 20 for a smooth impact and sound for an incorrect stroke which causes movable insert 8 to slide between impact transmitter 9 and the wall of tube 21, as shown by way of example in FIG. 26. The size of movable insert 8 is 25 to 30% less in diameter than the diameter of tube 21. In an unsuccessful stroke movable insert 8 has room to turn around its own axial line, hit the wall of tube 21, vibrate and significantly decrease the impact force, which produces a smooth, not explosive, and relatively quiet sound and less pushing of impact transmitter, impact cup and eventually the device forward. Movable inserts in many currently available devices have blunt impact surfaces and no significant room for axial movement or have a ring shape which is situated on a guide tube. These designs produce no different in sound quality depending on applied technique.

Figures 27, 28, 29, 30, 31, 32, 33:
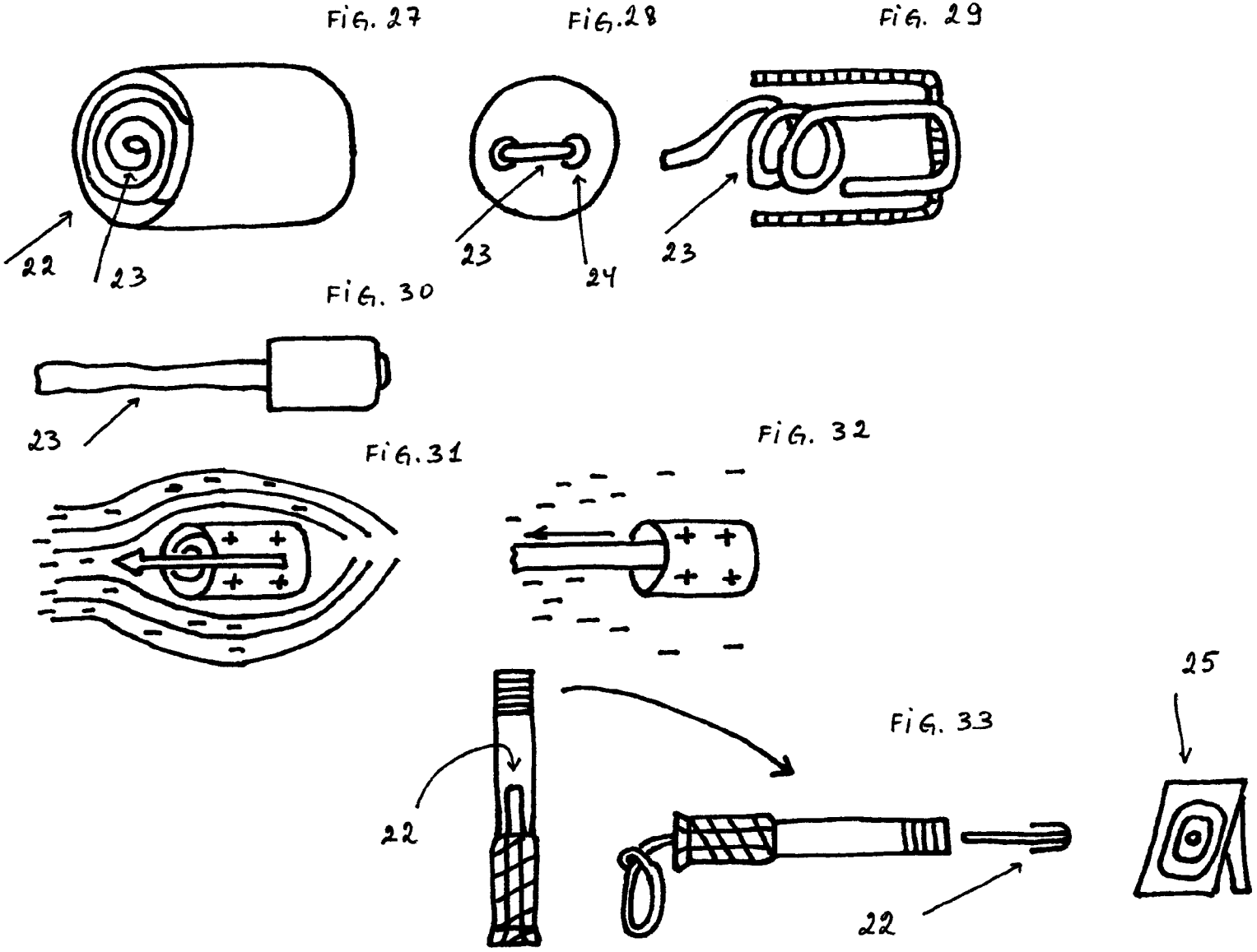
FIGS. 27 through 34 illustrate an exemplary movable insert for a shooting practice device, in accordance with an embodiment of the present invention.
Figure 34:
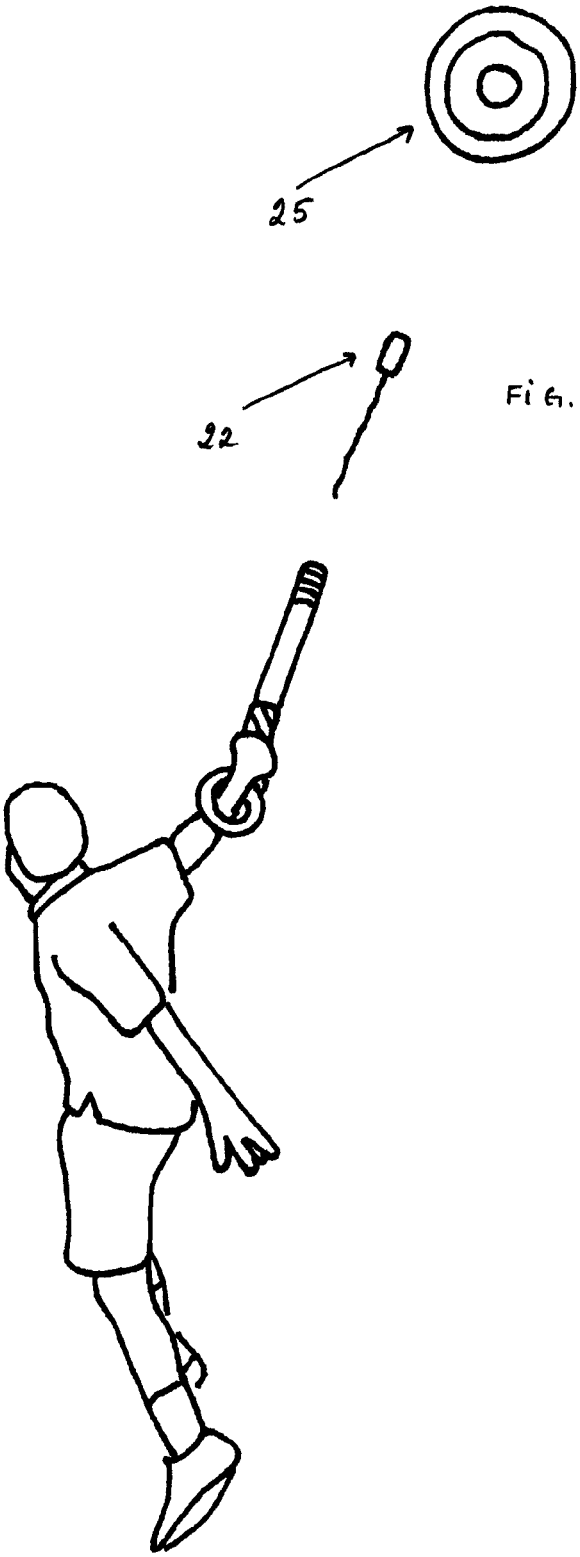

FIGS. 27 through 34 illustrate an exemplary movable insert 22 for a shooting practice device, in accordance with an embodiment of the present invention. FIG. 27 is a side perspective view. FIG. 28 is a diagrammatic end view. FIG. 29 is a cross sectional view. FIG. 30 is a side view with a tail 23 extended. FIG. 31 shows the air movement around movable insert 22. FIG. 32 shows the pressure within movable insert 22. FIG. 33 and FIG. 34 illustrate movable insert 22 in use. In the present embodiment, movable insert 22 is made from metal or plastic and is designed for shooting exercises. Movable insert 22 is a tube that is 1 to 1½ inches long and ½ to ⅝ of an inch in diameter and has a closed end and an open end. A 1-foot long ribbon tail 23 is located inside movable insert 22 and attached to the closed end of movable insert 22 through two surface holes 24. Referring to FIGS. 31 through 33, when in motion a difference in pressure exists inside movable insert 22 and outside movable insert 22, which causes ribbon tail 23 to extend from movable insert 22 so that it can be easily traced and found after hitting a target 25. Movable insert 22 is used in a device in which the free end of the tube is open. Because of size relation of movable insert 22 and a tube of the device (e.g., movable insert 22 is 25 to 30% smaller in diameter than the tube), when a non-perfect stroke is made movable insert 22 hits the tube wall, vibrates and falls from the tube without flying a distance. Referring to FIGS. 33 and 34, when a correct stroke with good extension occurs, movable insert 22 moves smoothly within the tube and is propelled out of the tube to be shot at target 25. Basic shooting exercises include hitting target 25 with backhand and forehand strokes from different distances. The flying distance and ballistics of movable insert 22 generally depend on the skills of the user.

Figures 35, 36, 37:
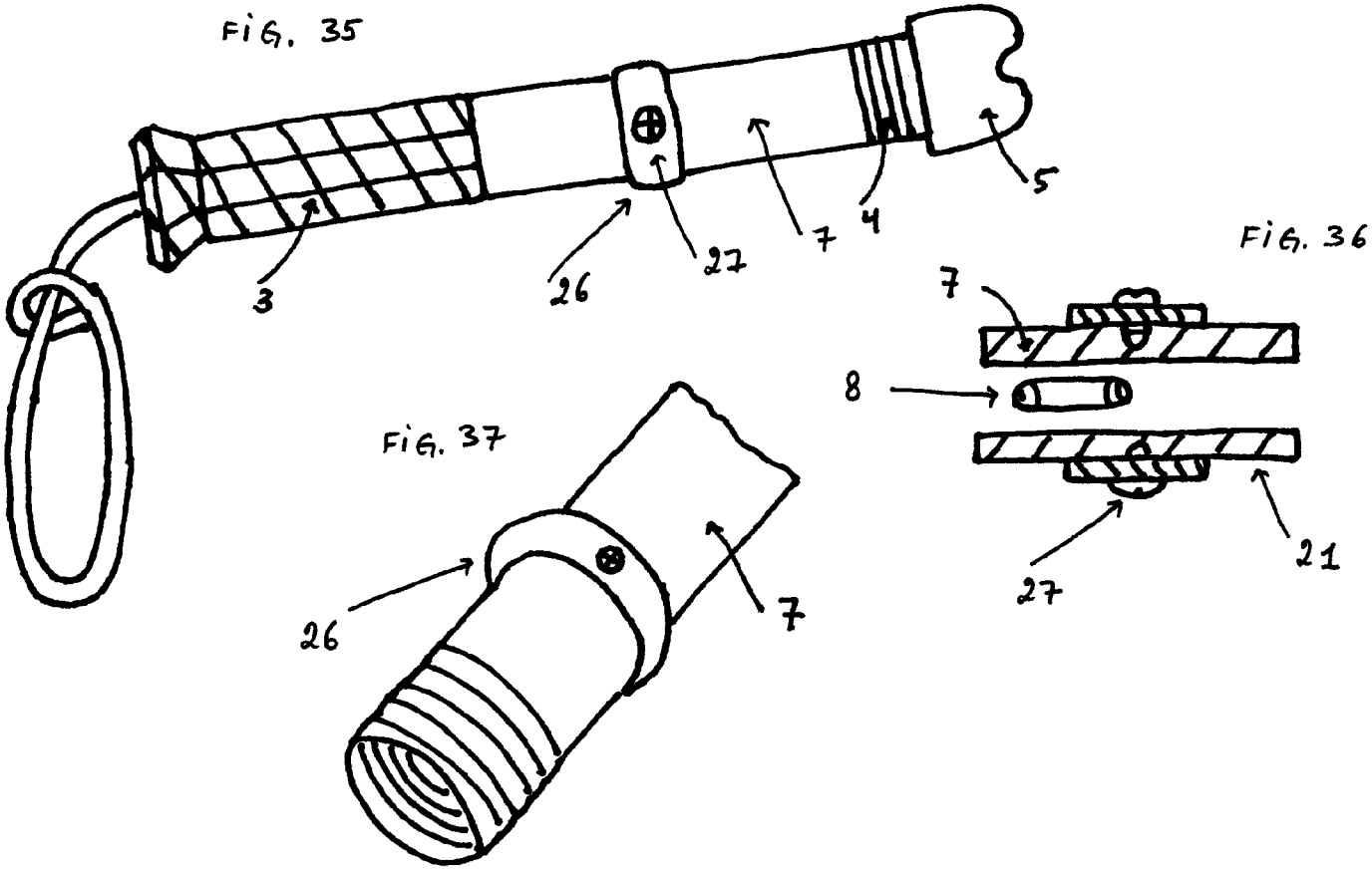
FIGS. 35 through 37 illustrate an exemplary balance adjuster for a stroke practice device, in accordance with an embodiment of the present invention.

FIGS. 35 through 37 illustrate an exemplary balance adjuster 26 for a stroke practice device, in accordance with an embodiment of the present invention. FIG. 35 is a diagrammatic side view of balance adjuster 26 on a device. FIG. 36 is a cross sectional view of balance adjuster 26 on a tube 7, and FIG. 37 is a side perspective view of balance adjuster 26 on tube 7. In the present embodiment, balance adjuster 26 moves on straight tube 7 from the end of a grip 3 to an impact cap 5. Balance adjuster 26 is attached to tube 7 by bolts 27 which may be loosened to move balance adjuster 26 and then tightened to hold it in the desired location. On the outer wall of tube 7 predrilled holes that are 1½ to 2 mm deep provide a secure bolt connection. Referring to FIG. 36, bolts 27 cannot penetrate the wall of tube 7 so as not to interfere with the movement of a movable insert 8. In some alternate embodiments, the balance adjuster may be attached to the tube with screws or with clips on the body of the tube. Balance adjuster 26 is a movable part designed to change the balance of the device to mimic the balance of a tennis racquet for stroke and shooting exercises. When impact cap 5 is removed for a shooting exercised, balance adjuster 26 can be positioned on tube threads 4. Tennis racquets vary in balance (i.e., middle or head side). Tennis players who like to attack generally prefer a head side balance and defenders generally prefer middle side balance. Moving balance adjuster 26 toward grip 3 increase the amount of a force necessary to produce a successful stroke. Moving balance adjuster 26 toward impact cap 5 increases the amount of control needed to produce a successful stroke.

Figure 38:
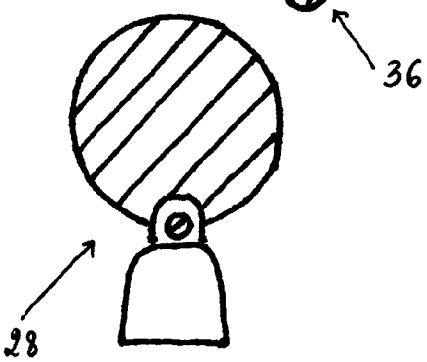
FIG. 38 is a diagrammatic front view of an exemplary sweet spot racquet, in accordance with an embodiment of the present invention.

Those skilled in the art, in light of the teachings of the present invention will readily recognize that a multiplicity of suitable accessories may be attached to stroke practice devices according to some embodiments. FIGS. 38 through 44 illustrate some exemplary attachments. FIG. 38 is a diagrammatic front view of an exemplary sweet spot racquet 28, in accordance with an embodiment of the present invention. In the present embodiment, sweet spot racquet 28 can be used to hit a ball 36 to practice aiming at a sweet spot of an actual tennis racquet. Accessories may be attached to stroke practice devices through an impact cup attachment hole 6 by bolt 13 and nut 12 placed in notch 11 of an impact cup 5 as shown in FIG. 14.

Figure 39:
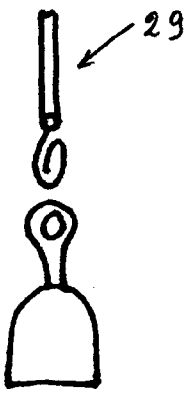
FIG. 39 is a diagrammatic front view of an exemplary rubber resistance attachment, in accordance with an embodiment of the present invention.

FIG. 39 is a diagrammatic front view of an exemplary rubber resistance attachment 29, in accordance with an embodiment of the present invention. A rubber tube or strap may be attached to a hook having a threaded end through impact cap attachment hole 6 attached to a stroke practice device. All exercises the same and with the same impact features, but more enhanced because a rubber tube resistant.

Figure 40:
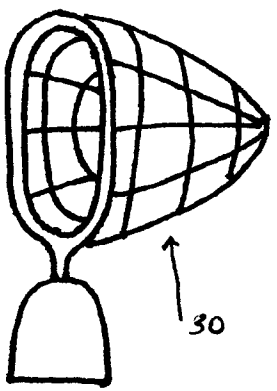
FIG. 40 is a side perspective view of an exemplary swing net, in accordance with an embodiment of the present invention.

FIG. 40 is a side perspective view of an exemplary swing net 30, in accordance with an embodiment of the present invention. Swing net 30 is attached to a stroke practice device through impact cap 5 attachment hole 6 by a threaded end and a nut 12 at notch 11. An impact sound produced by stroke practice device corresponds a real tennis racquet and ball impact sound. For this exercise a real tennis ball is used and a user needs to catch the ball with the swing net when an impact sound of the stroke practice device is heard.

Figure 41:
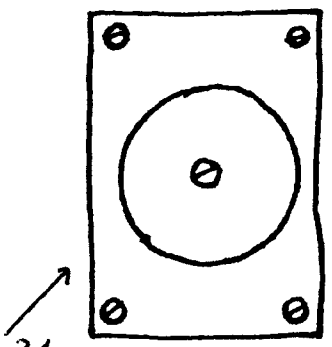
FIG. 41 is a front diagrammatic view of an exemplary wall magnet, in accordance with an embodiment of the present invention.

FIG. 41 is a front diagrammatic view of an exemplary wall magnet 31, in accordance with an embodiment of the present invention. In a wall magnet exercises a magnetic (metal) surface attached to a wall. In a non-limiting example, a 12 inch and 2 mm thick metal circle may be attached to the wall. User performs exercises with a stroke practice device having magnet attachment shown in FIGS. 42A and 42B.

Figure 42B:
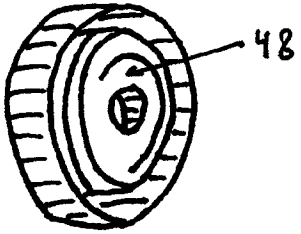
FIGS. 42A, 42B and 42C illustrate an exemplary magnet attachment in accordance with an embodiment of the present invention.
Figure 42A:
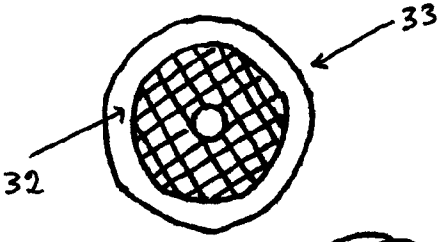
Figure 42C:
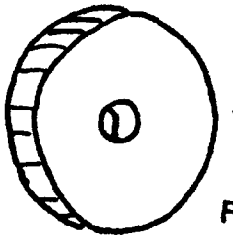

FIGS. 42A, 42B and 42C illustrate an exemplary magnet attachment 32, in accordance with an embodiment of the present invention. FIG. 42A is a diagrammatic front view, FIG. 42B is a side perspective view, and FIG. 42C is a side perspective view of a soft impact screen 34. In the present embodiment, magnet attachment 32 comprises a magnet 48, a magnet cap 33 and a soft impact screen 34. Magnet attachment 32 is attached to a device similarly to the manner in which a weight attachment 35 is attached to a device as shown by way of example in FIG. 44. A magnet attachment 32 may aid in development of a tennis stroke. A tennis stroke feature is a very short, powerful and directed, toward the target, initiation and relaxation. A relaxation is when a device furthest from a body of the user. Common devices used for developing and practice tennis strokes use resistance cords such as, but not limited to, rubber tubes, straps and weight appliances. They work opposite to a tennis stroke technique. Further from a body of user more resistance or more force needed. The important relaxation feature of a tennis stroke disappears. Practice with a resistance or weights appliances helps with good muscles development, but not tennis stroke technique. In a tennis stroke, a technique brings a power and direction, not muscles. For magnet exercises two stroke practice devices with magnet attachments 32 are used, one in each hand. The magnets are oriented to attract each other. A user keeps a stroke practice device in each hand with magnets in contact and initiates a hand movements in opposite direction. Practice with both hands aid with a tennis stroke development. Both hands participate in a tennis stroke, hitting with a racquet and balancing. The same may apply to a two handed tennis stroke technique. Soft impact screen 34 is used to smooth contact forces between magnets, to mitigate magnet breakage and reduce a force needed to separate them. In non-limiting examples an adult may need a one screen, but a child may need three or more to make a magnet forces less. In some embodiments, soft impact screens may be made from a plastic material and correspond a shape and size of the magnet.

Figure 43B:
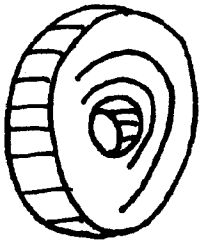
FIGS. 43A, 43B and 44 illustrate an exemplary weight attachment, in accordance with an embodiment of the present invention.
Figure 43A:
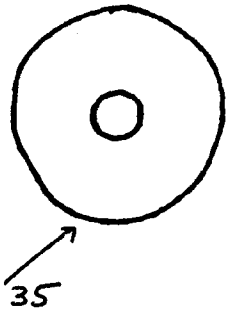
Figure 44:
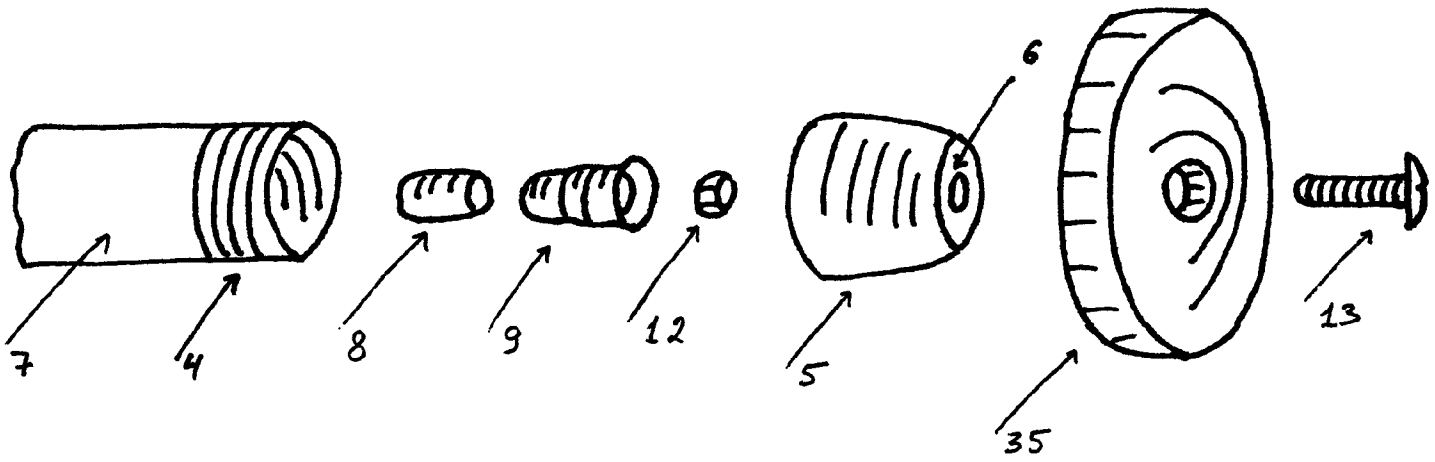

FIGS. 43A, 43B and 44 illustrate an exemplary weight attachment 35, in accordance with an embodiment of the present invention. FIG. 43A is a diagrammatic front view. FIG. 43B is a side perspective view, and FIG. 44 shows weight attachment 35 being attached to a stroke practice device. In the present embodiment, weight attachment 35 may be attached to the free end of a stroke practice device to practice weighted swings and to help practice forward movement. Referring to FIG. 44, weighted attachment 35 is attached to an impact cap 5 with an attachment bolt 13 and a nut 12. Impact cap 5 screws onto threads on the end of a tube 7, which comprises a movable insert and an impact transmitter 9.

Figures 45, 46:
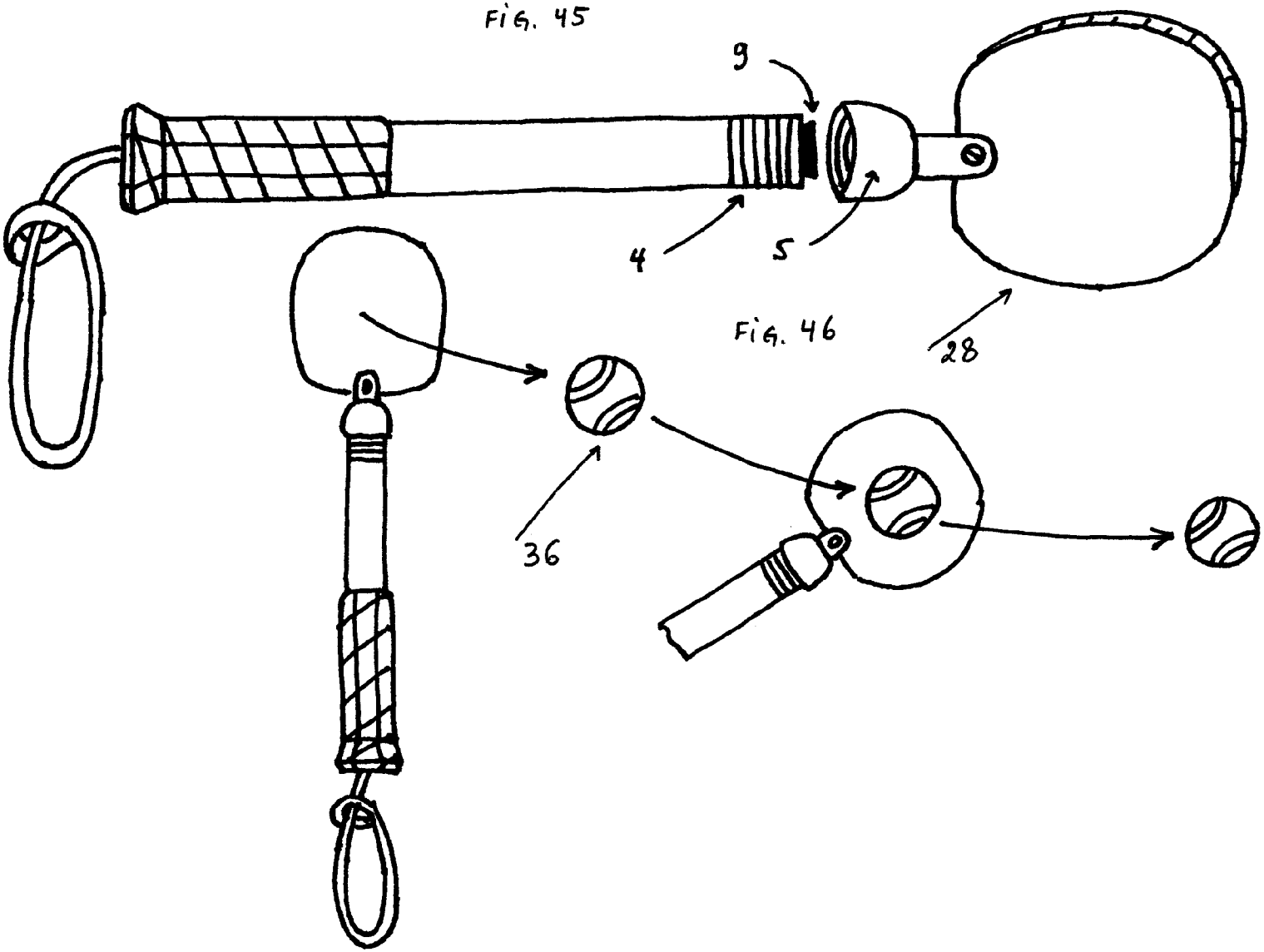
FIGS. 45 and 46 illustrate an exemplary stroke practice device with a sweet spot racquet attached, in accordance with an embodiment of the present invention.

FIGS. 45 and 46 illustrate an exemplary stroke practice device with a sweet spot racquet 28 attached, in accordance with an embodiment of the present invention. FIG. 45 is a partially exploded view, and FIG. 46 shows the device in use hitting a ball 36. In the present embodiment, sweet spot racquet 28 is mounted to an impact cap 5. Sweet spot racquet 28 has a threaded end for insertion through an impact cap 5 attachment hole 6 to be secured by nut 12 placed at notch 11. The small size of sweet spot racquet 28 relative to a typical tennis racquet enables a user to practice striking ball 36 with an area the approximate size of the sweet spot of a typical tennis racquet.

Figures 47, 48:
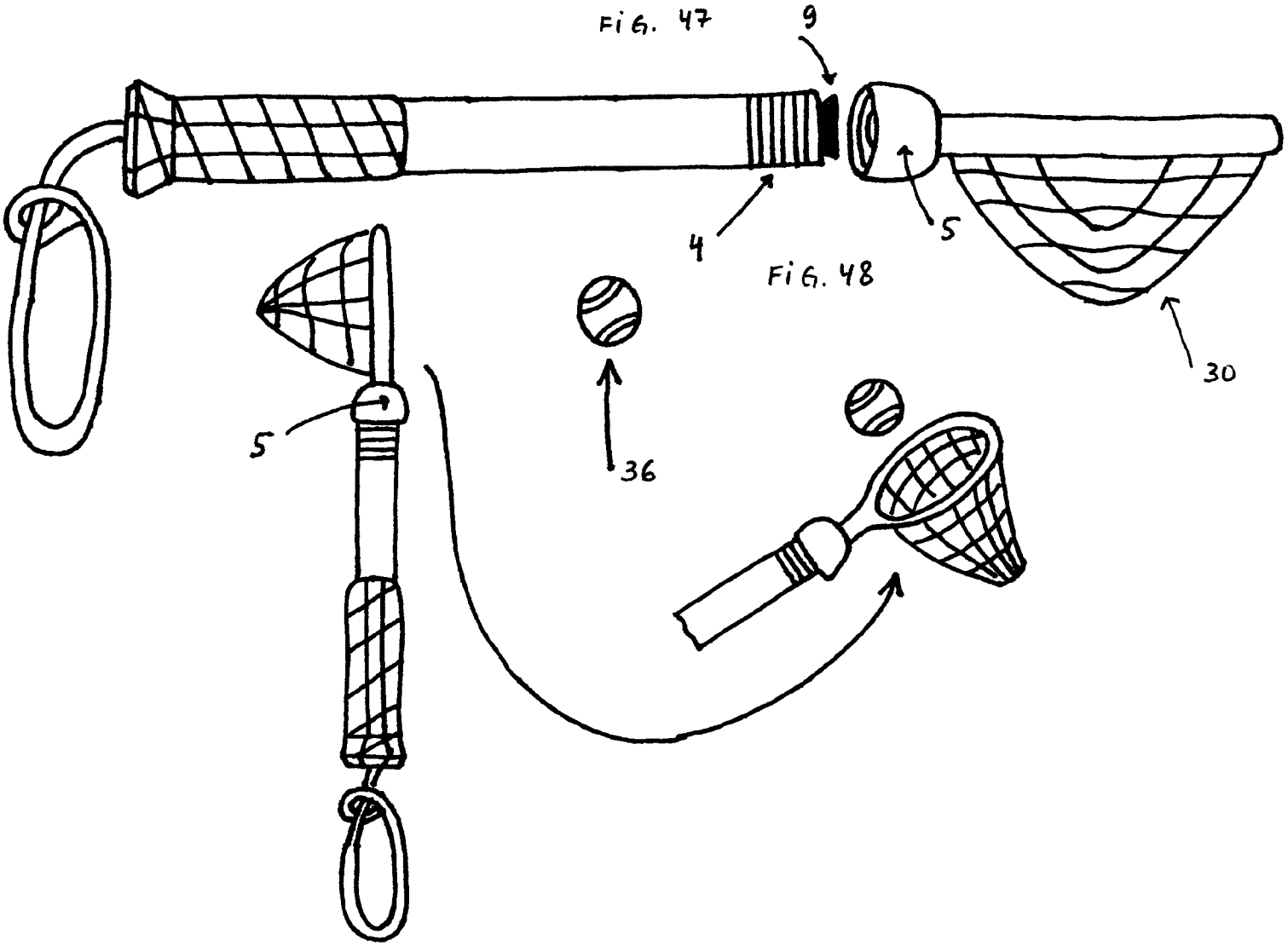
FIGS. 47 and 48 illustrate an exemplary stroke practice device with a swing net attached, in accordance with an embodiment of the present invention.

FIGS. 47 and 48 illustrate an exemplary stroke practice device with a swing net 30 attached, in accordance with an embodiment of the present invention. FIG. 47 is a partially exploded view, and FIG. 48 shows swing net 30 in use with a ball 36. In the present embodiment, swing net attaches to an impact cap 5. Swing net has a threaded end for insertion through an impact cap attachment hole 6 to be secured by nut 12 placed in notch 11. Swing net 30 enables a user to catch ball 36 in order to. An impact sound of stroke practice device corresponds a tennis ball and racquet impact. In this exercise a user uses a real tennis ball and needs to catch it when an impact sound is heard.

Figure 50:
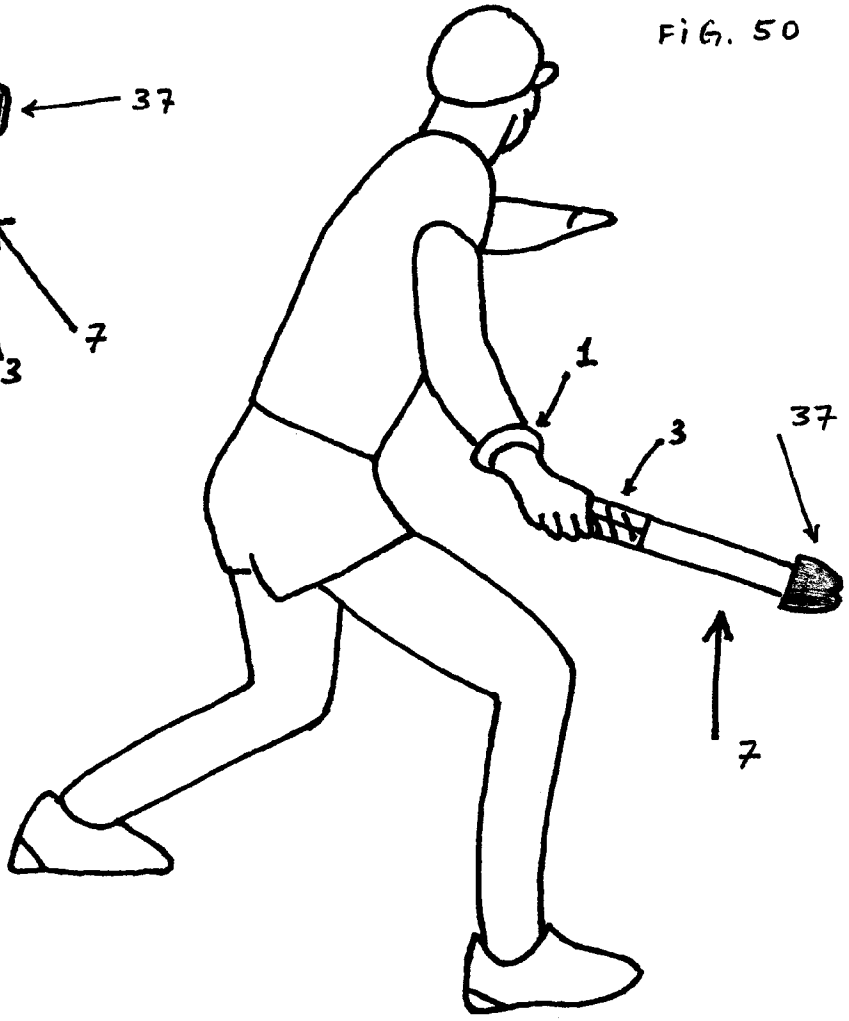
FIGS. 49 and 50 illustrate an exemplary stroke practice device in use, in accordance with an embodiment of the present invention.
Figure 49:
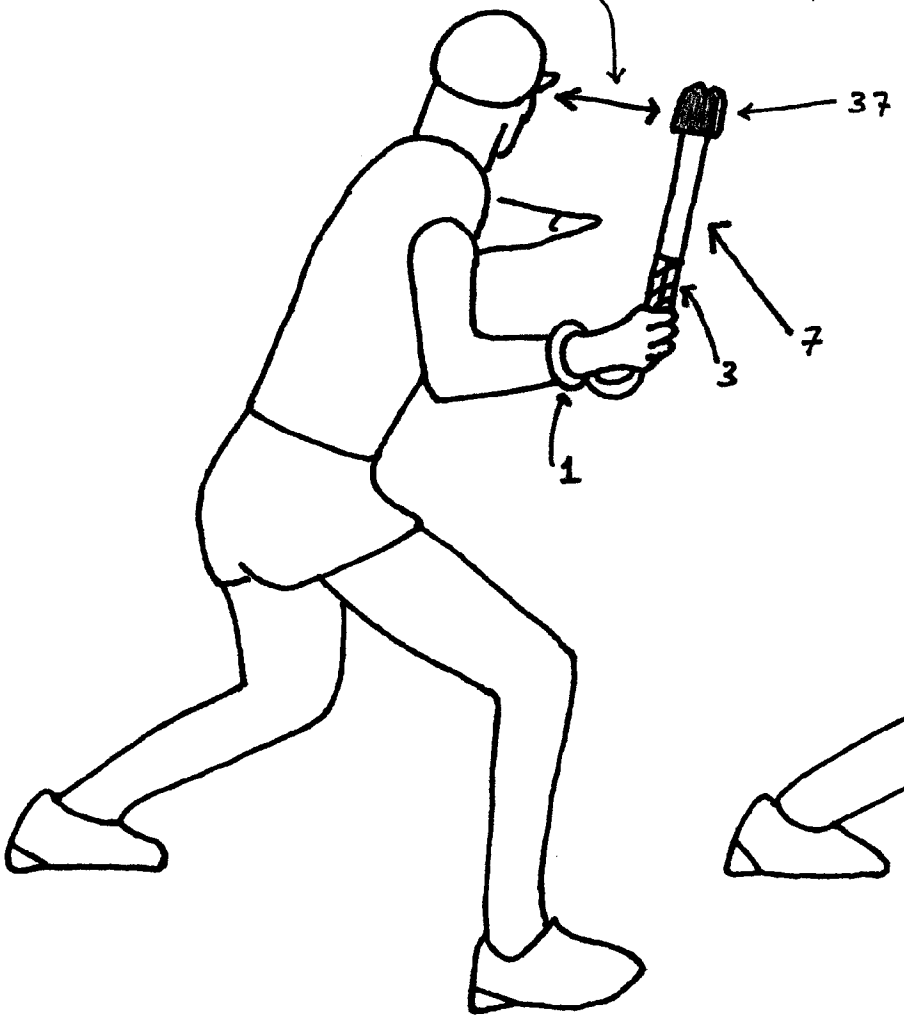

FIGS. 49 and 50 illustrate an exemplary stroke practice device in use, in accordance with an embodiment of the present invention. FIG. 49 shows a user before taking a swing, and FIG. 50 shows the user during a swing. In the present embodiment, the user holds a grip 3 with a secure strap 1 around his wrist. While swinging, a movable insert inside a tube 7 moves and strikes an impact transmitter. Depending on the technique of the swing, the movable insert may hit the impact transmitter squarely to produce a loud, clear, explosive sound to indicate a correct swing or may hit the impact transmitter indirectly producing a dull vague sound which indicates an incorrect swing. An impact cap 37, which has a distinct color, is in a visual line 38 of the user to remind the user to focus on the racquet during the swing. Similar to many currently available devices, the present embodiment comprises upper and lower impact areas. Therefore, when the user returns the device to the pre-swing, starting position, gravity returns the movable insert to the grip end of tube 7 where the movable insert strikes the lower impact area to produce an impact sound.

Figures 51, 52, 53:
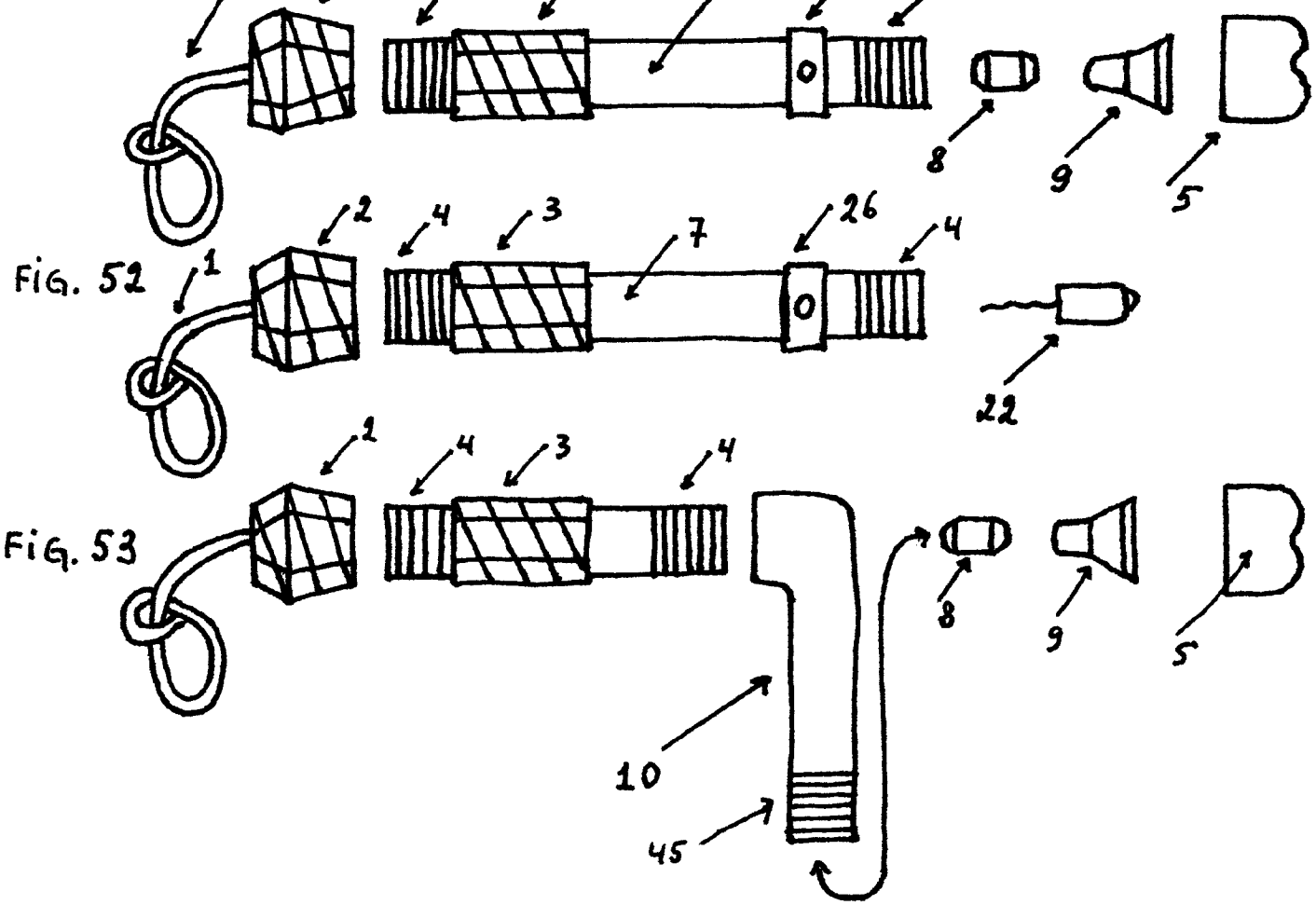
FIG. 51 is an exploded view of an exemplary practice device to practice stroke exercises, in accordance with an embodiment of the present invention.
FIG. 52 is an exploded view of an exemplary practice device to practice shooting exercises, in accordance with an embodiment of the present invention.
FIG. 53 is an exploded view of an exemplary practice device to practice volley exercises, in accordance with an embodiment of the present invention.

FIG. 51 is an exploded view of an exemplary practice device to practice stroke exercises, in accordance with an embodiment of the present invention. In the present embodiment, the device comprises a secure strap 1, a grip 3, a detachable grip-bud 2, a straight central tube 7, a movable insert 8, an impact transmitter 9, an impact cap 5, and balance adjuster 26. This device may be used to practice a forehand, backhand or serve.

FIG. 52 is an exploded view of an exemplary practice device to practice shooting exercises, in accordance with an embodiment of the present invention. In the present embodiment, the device comprises a secure strap 1, a grip 3, a detachable grip-bud 2, a straight central tube 7, a balance adjuster 26, and a movable insert 22 with a tail.

FIG. 53 is an exploded view of an exemplary practice device to practice volley exercises, in accordance with an embodiment of the present invention. In the present embodiment, a secure strap 1, a grip 3, a detachable grip-bud 2, a straight central tube 7, a curved tube 10, a movable insert 8, an impact transmitter 9, and an impact cap 5.

Figure 54:
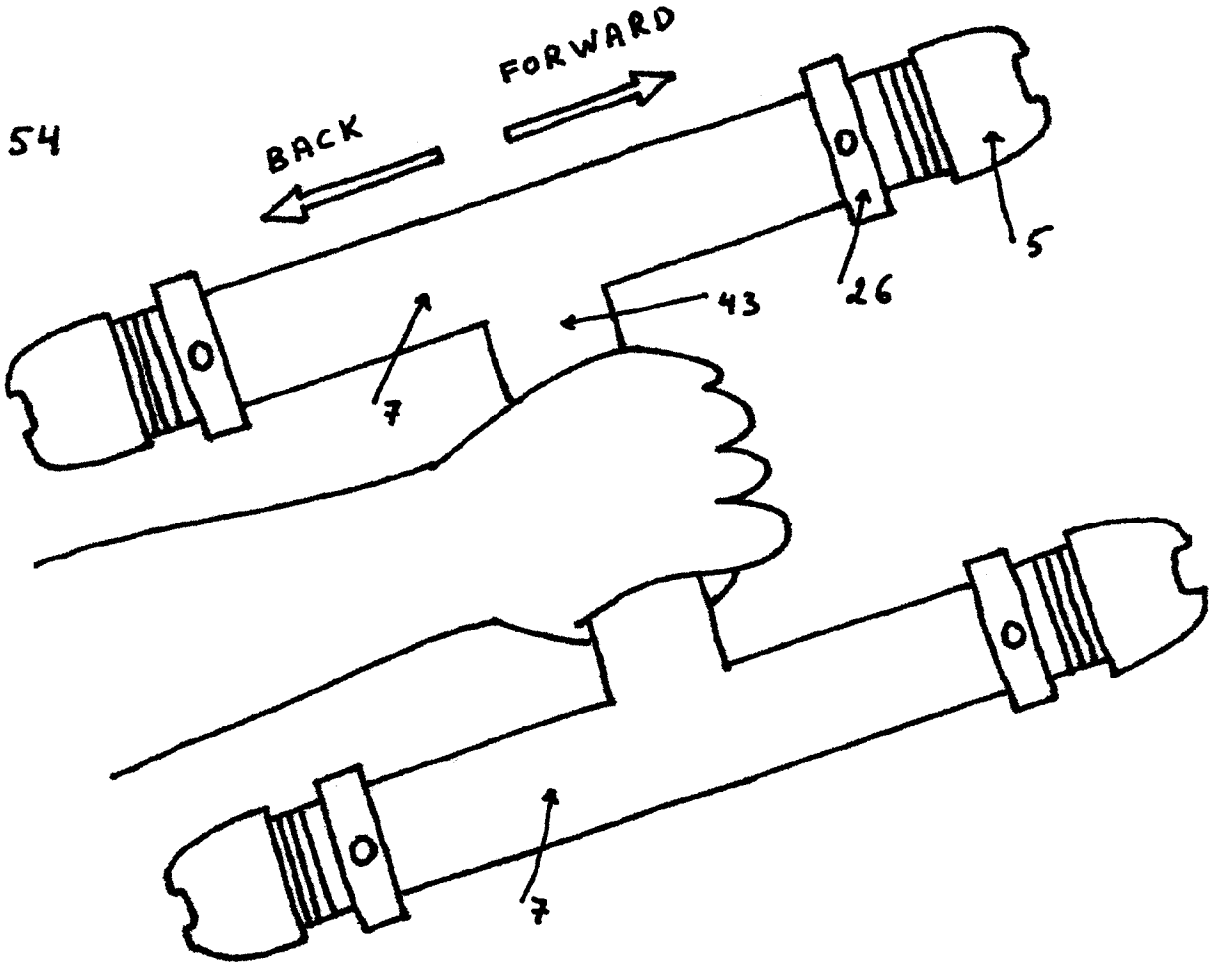
FIGS. 54 and 55 illustrate an exemplary double insert device, in accordance with an embodiment of the present invention.
Figure 55:
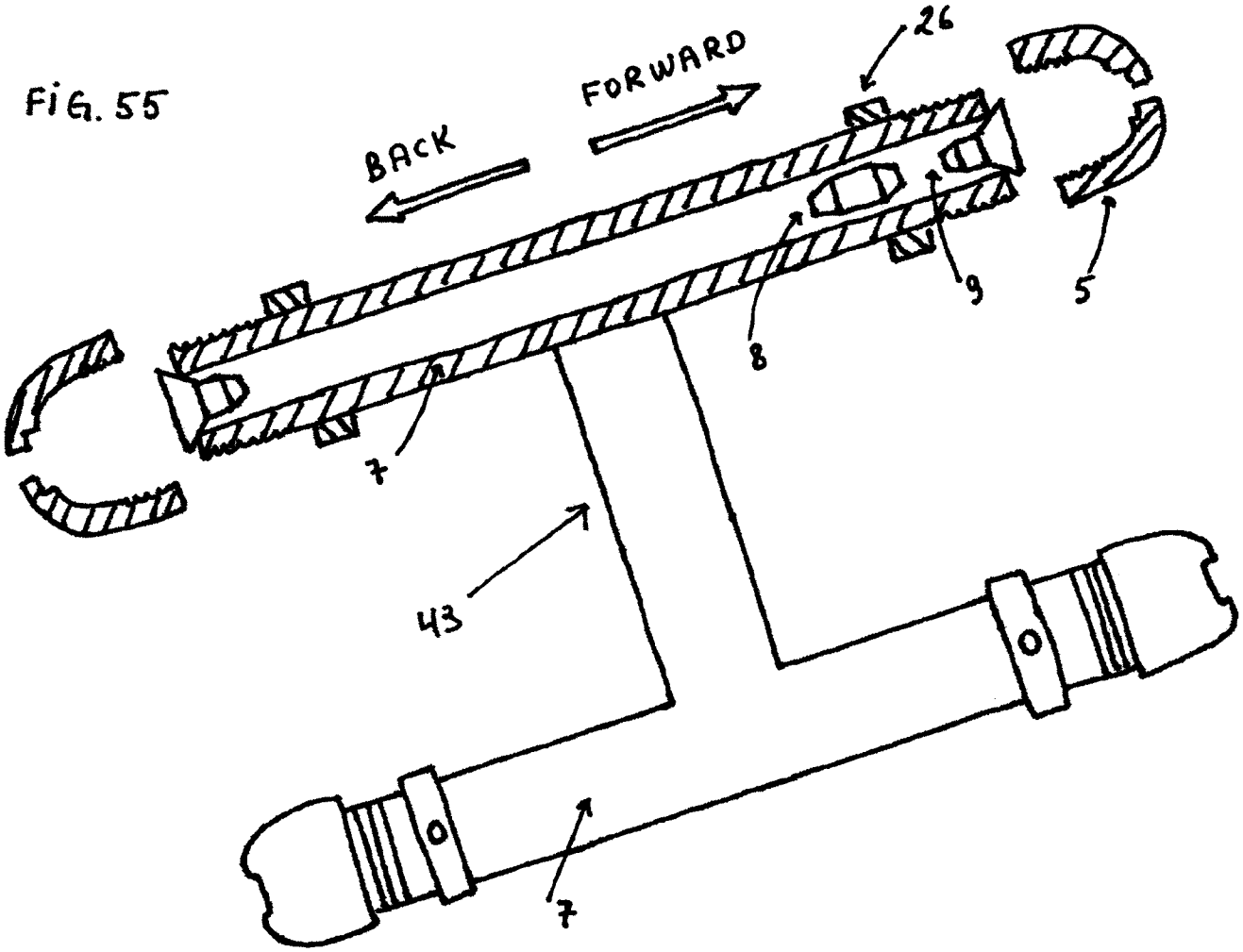

FIGS. 54 and 55 illustrate an exemplary double insert device, in accordance with an embodiment of the present invention. FIG. 54 is a diagrammatic side view, and FIG. 55 is a partially cut away view. In the present embodiment, the double insert device is designed to practice maximum speed and extension of the hands from a short distance. This practice can be performed by one or both hands and in a forward or backward direction. The double insert device comprises two straight central tubes 7 with no grips, a balance adjuster 26 on each side of each straight central tube 7, movable inserts 8 inside each straight central tube 7, impact transmitters 9 on each side of each straight central tube 7, an impact cap 5 on each side of each straight central tube 7 and a rigid connector 43 in the middle connecting straight central tubes 7. In typical use of the present embodiment, a basic exercise involves keeping the hands in front of the body and producing hitting strokes forward and backward in a controlled manner to produce loud, explosive, clear and simultaneous impact sounds.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of providing stroke practice devices according to the present invention will be apparent to those skilled in the art. The invention has been described above by way of illustration, and the specific embodiments disclosed are not intended to limit the invention to the particular forms disclosed. For example, the particular implementation of the device may vary depending upon the particular type of sport for which it is to be used. The devices described in the foregoing were directed to tennis stroke implementations; however, similar techniques are to implement stroke practice devices for various different sports including, without limitation, racquetball, baseball, volleyball, golf, etc. Non-tennis implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A device comprising:

a central tube section comprising at least a threaded first end portion, a threaded second end portion and a central hollow interior portion, wherein said threaded first end portion being configured to be operable for attaching accessories;

a grip-bud, in which said grip bud comprising at least a detachable threaded grip-bud contraption, wherein said detachable threaded grip-bud contraption being configured to be removably joinable to said threaded first end portion, and wherein said detachable threaded grip-bud contraption being configured to close said central hollow interior portion at said threaded first end portion;

a grip implement, wherein said grip implement is disposed proximate a grip side portion of said central tube section;

a movable insert implement having a closed end segment and an open end segment, wherein said movable insert implement is configured to be operable for moving freely through said central hollow interior portion;

a ribbon tail part, said ribbon tail part is engaged to said closed end segment of said movable insert implement through two surface holes at said closed end segment, wherein said ribbon tail part is configured to extend out of said open end segment when said movable insert is in motion; and a strap implement wherein said strap implement is operable to secure said device to a wrist of a user.

2. The device as recited in claim 1, in which said grip-bud is attached to said strap implement.

* * * * *